US011322888B2

(12) United States Patent
Yasuda et al.

(10) Patent No.: US 11,322,888 B2
(45) **Date of Patent: *May 3, 2022**

(54) LEVER-TYPE CONNECTOR

(71) Applicant: SUMITOMO WIRING SYSTEMS, LTD., Mie (JP)

(72) Inventors: Tomoaki Yasuda, Mie (JP); Satoru Nishide, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/058,244

(22) PCT Filed: Oct. 22, 2018

(86) PCT No.: PCT/JP2018/039165

§ 371 (c)(1),
(2) Date: Nov. 24, 2020

(87) PCT Pub. No.: WO2019/234950

PCT Pub. Date: Dec. 12, 2019

(65) Prior Publication Data

US 2021/0203101 A1 Jul. 1, 2021

(30) Foreign Application Priority Data

Jun. 6, 2018 (JP) ..... JP2018-108704

(51) Int. Cl.
*H01R 13/629* (2006.01)

(52) U.S. Cl.
CPC ..... *H01R 13/62938* (2013.01)

(58) Field of Classification Search
CPC ..... H01R 13/62938; H01R 13/4538
See application file for complete search history.

(56) References Cited

U.S. PATENT DOCUMENTS 10,594,079 B2 * 3/2020 Yasuda ..... H01R 13/71
10,644,445 B2 * 5/2020 Yasuda ..... H01R 13/6295
10,644,446 B2 * 5/2020 Yasuda ..... H01R 13/62955

FOREIGN PATENT DOCUMENTS

JP H11-067337 A 3/1999
JP 2006-196225 A 7/2006
(Continued)

OTHER PUBLICATIONS

International Search Report dated Dec. 25, 2018 for WO 2019/234950 A1 (4 pages).

*Primary Examiner* — Vanessa Girardi
(74) *Attorney, Agent, or Firm* — Abelman, Frayne & Schwab

(57) ABSTRACT

A lever (24) is formed with a separating cam surface (30) and an escaping space (31) disposed in a region more distant from a rotary shaft (13) than the separating cam surface (30). The separating cam surface (30) presses cam projections (23) of a moving plate (18) in a direction away from the rotary shaft (13) to separate both housings (10, 40) in the process of rotating the lever (24) to an initial position with the both housings (10, 40) connected. The cam projections (23) are accommodated into the escaping space (31) while being separated from the separating cam surface (30) in the process of rotating the lever (24) from the initial position to a connection position with the both housings (10, 40) separated and the moving plate (18) located at a protection position.

10 Claims, 24 Drawing Sheets

(56) References Cited

FOREIGN PATENT DOCUMENTS

| | | | |
|---|---|---|---|
| JP | 2011-142050 | A | 7/2011 |
| KR | 10-1348186 | B1 | 1/2014 |
| WO | 2014/199899 | A1 | 12/2014 |

* cited by examiner

LEVER-TYPE CONNECTOR

CROSS REFERENCE TO RELATED APPLICATIONS

This application is a national phase of PCT application No. PCT/JP2018/039165, filed on 22 Oct. 2018, which claims priority from Japanese patent application No. 2018-108704, filed on 6 Jun. 2018, all of which are incorporated herein by reference.

TECHNICAL FIELD

The present invention relates to a lever-type connector.

BACKGROUND

Patent Document 1 discloses a lever-type connector with a male housing including a tubular receptacle projecting forward, a lever rotatably mounted on the male housing, a moving plate accommodated in the receptacle with tabs of male terminal fittings positioned by being passed through the moving plate, and a female housing to be fit into the receptacle. The moving plate is movable between a protection position where front end parts of the tabs are passed through the moving plate and a retracted position behind the protection position.

In connecting the both housings, the female housing is accommodated into the receptacle with the lever located at an initial position, and a cam pin of the female housing and a cam projection of the lever are united and caused to enter the entrance of a cam groove of the lever. If the lever is rotated toward a connection position from this state, the female housing is pulled toward the male housing and the both housings are connected by a boosting action due to the sliding contact of the cam pin and the cam groove.

If the lever is rotated to the initial position with the both housings connected, the moving plate moves to a front end side of the receptacle to push the female housing away from the male housing by the boosting action due to the sliding contact of the cam projection and the cam groove. Thus, the both housings can be separated. If the lever returns to the initial position, the moving plate returns to the protection position to cause the front end parts of the tab to pass therethrough.

PRIOR ART DOCUMENT

Patent Document

Patent Document 1: JP H11-067337A

SUMMARY OF THE INVENTION

Problems to be Solved

In the above lever-type connector, if the lever is rotated between the initial position and the connection position with the both housings separated, the moving plate moves to a back side of the receptacle due to the sliding contact of the cam projection and the cam groove. If the moving plate moves to the back side of the receptacle, the tabs are exposed in front of the moving plate. Thus, there is a concern that an external matter interferes with the tabs.

The present invention was completed on the basis of the above situation and aims to restrict a movement of a moving plate when a lever is rotated with a male housing and a female housing separated.

Means to Solve the Problem

The present invention is directed to a lever-type connector with a male housing including a tubular receptacle projecting toward a front surface side, a plurality of male terminal fittings mounted in the male housing, the male terminal fittings including tabs surrounded by the receptacle, a moving plate accommodated in the receptacle, the moving plate being movable between a protection position where tip parts of the plurality of tabs are positioned by being passed through the moving plate and a retracted position more toward a back surface side than the protection position, a cam projection formed on the moving plate, a lever mounted on the male housing, the lever being rotatable between an initial position and a connection position, and a female housing fittable into the receptacle, wherein the lever is formed with a separating cam surface and an escaping space disposed in a region more distant from a center of rotation of the lever than the separating cam surface, the separating cam surface presses the cam projection in a direction away from the center of rotation of the lever to move the moving plate from the retracted position to the protection position in the process of rotating the lever at the connection position to the initial position with the male housing and the female housing connected, and the cam projection is accommodated into the escaping space while being separated from the separating cam surface in the process of rotating the lever from the initial position to the connection position with the male housing and the female housing separated and the moving plate located at the protection position.

Effect of the Invention

With the both housings separated, the cam projection is pressed by the separating cam surface to be disposed at a position most distant from the center of rotation of the lever. The escaping space is disposed in the region more distant from the center of rotation of the lever than the separating cam surface. In this way, the cam projection accommodated in the escaping space does not approach the center of rotation of the lever in the process of rotating the lever toward the connection position with the both housings separated. Thus, the moving plate is held at the protection position.

DETAILED DESCRIPTION TO EXECUTE THE INVENTION

Figure 1:
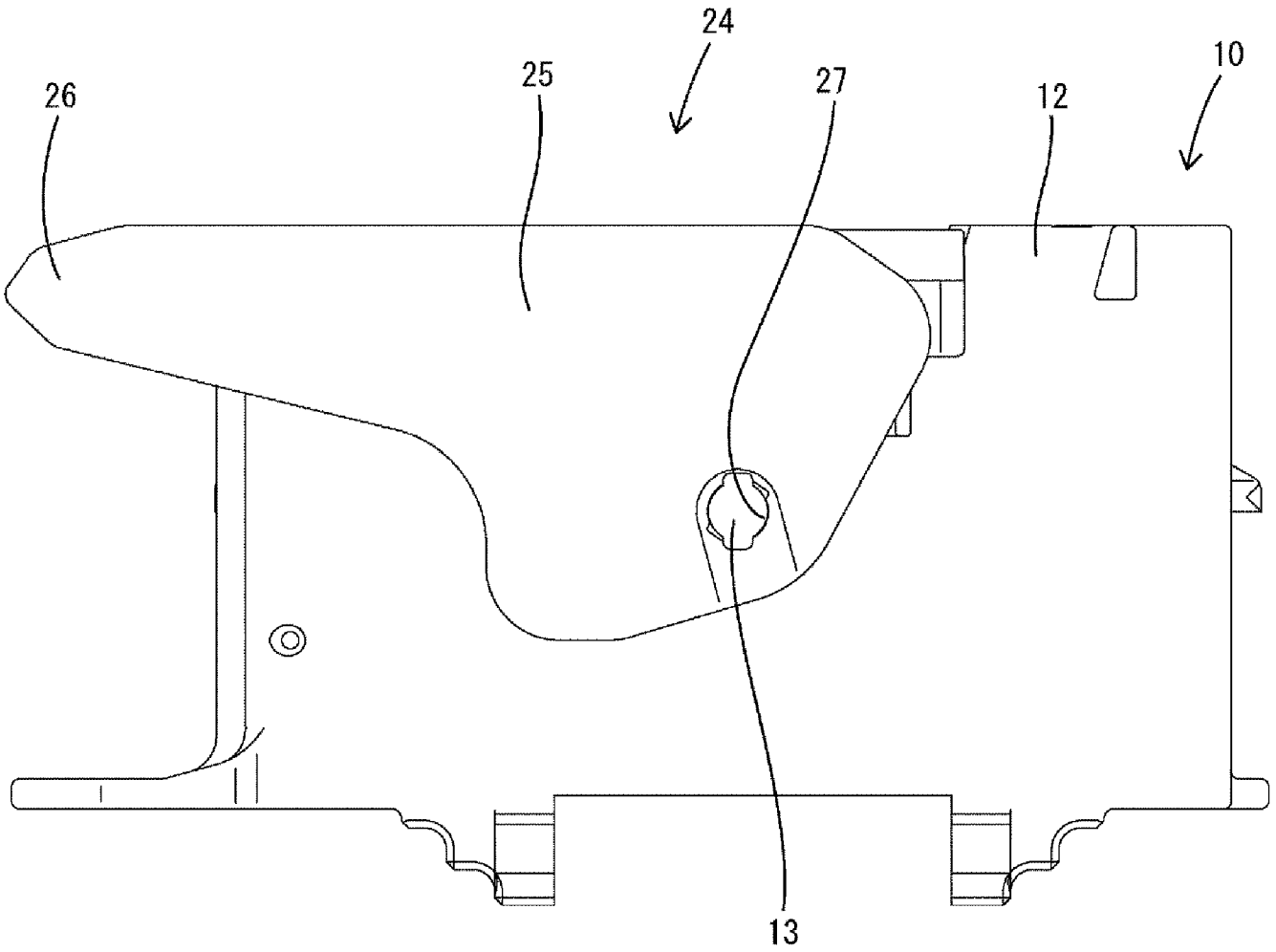
FIG. 1 is a side view showing a state where a lever is at an initial position on a male housing constituting a lever-type connector of one embodiment.
Figure 2:
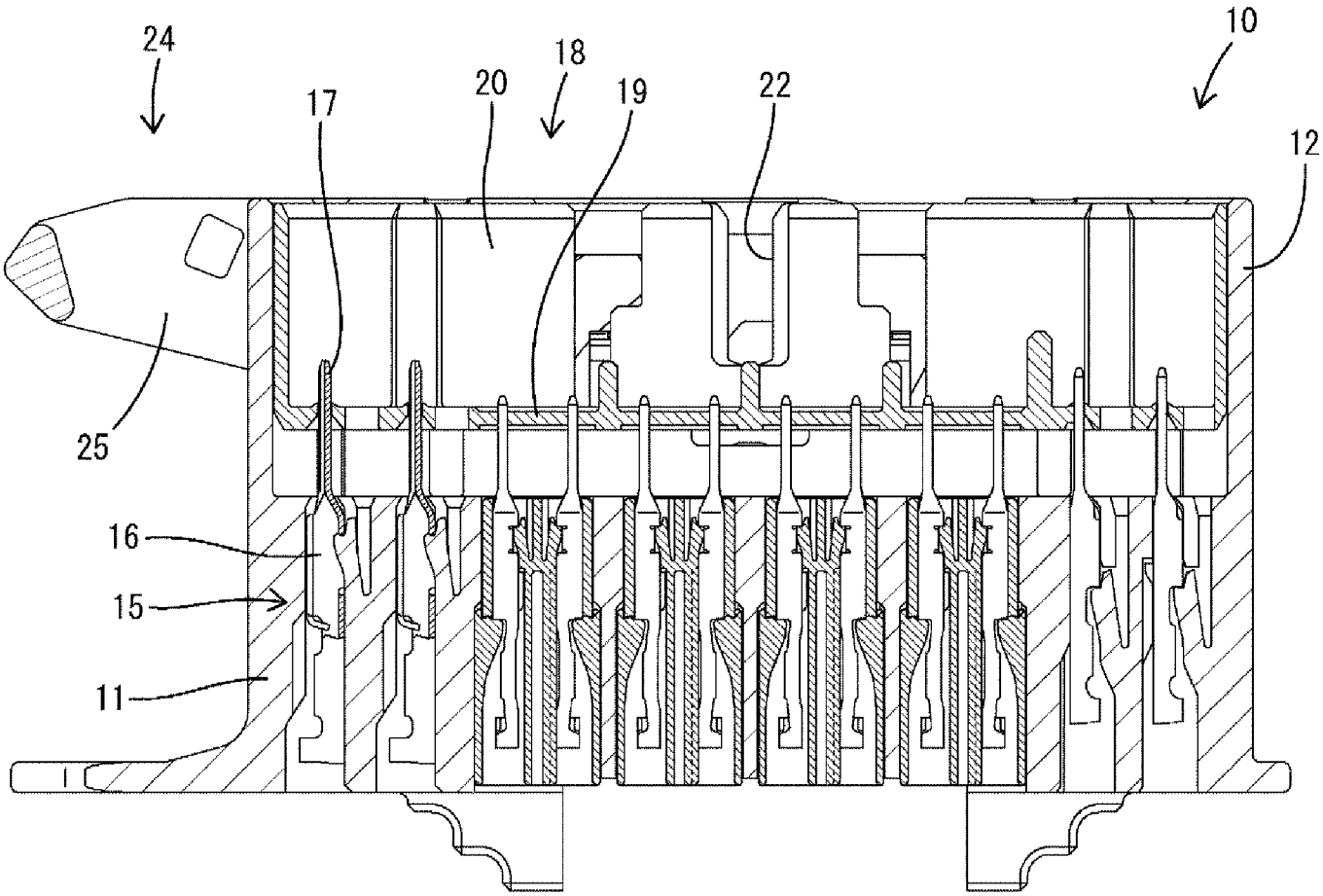
FIG. 2 is a side view in section when the lever is at the initial position with the male housing and a female housing separated.
Figure 3:
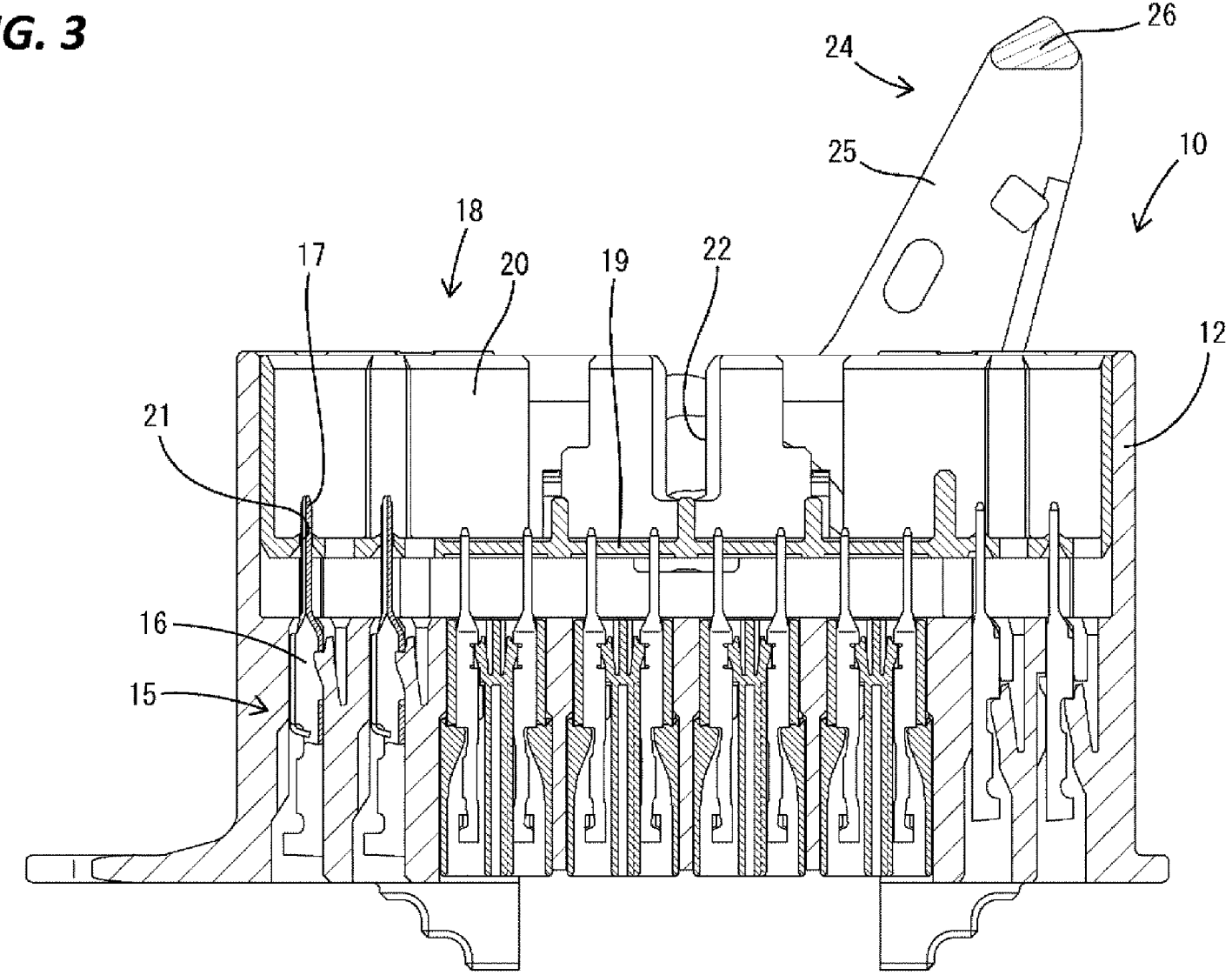
FIG. 3 is a side view in section when the lever is at a connection position with the male and female housings separated.

The present invention may be such that the lever-type connector includes a cam groove formed in the lever, and a cam pin formed on the female housing, the cam pin being pressed in a connecting direction by the cam groove as the lever is rotated from the initial position to the connection position in a connection process of the male housing and the female housing, the escaping space communicates with the cam groove, and the separating cam surface is formed in the cam groove. According to this configuration, the cam groove serves as both a movement path for the cam pin in the connection process of the both housings and a movement path for the cam projection in a separation process of the both housings. Thus, the shape of the lever can be simplified as compared to the case where a separation movement path exclusive for the cam projection is formed in the lever separately from the cam groove.

The present invention may be such that the escaping space is less recessed than the cam groove, and a projecting dimension of the cam pin is set larger than a projecting dimension of the cam projection. According to this configuration, erroneous entrance of the cam pin into the escaping space can be prevented in the connection process of the both housings.

The present invention may be such that the cam groove is formed with a connecting cam surface not in contact with the cam projection and configured to give a pressing force to the cam pin in the process of connecting the male housing and the female housing. According to this configuration, the cam projection and the cam pin can be moved in a united state in the cam groove in the process of connecting the both housings.

The present invention may be such that an entrance of the escaping space is adjacent to and communicates with an entrance of the cam groove. According to this configuration, since the entrance of the cam groove and that of the escaping space are adjacent to and communicate with each other, the shape of the lever can be simplified as compared to the case where the entrance of the cam groove and that of the escaping space are separate spaces.

The present invention may be such that the lever is formed with a restricting surface disposed to face the center of rotation of the lever and extend along an outer peripheral edge of the escaping space. According to this configuration, the separation of the moving plate at the protection position toward the front surface side of the receptacle can be prevented by the contact of the cam projection with the restricting surface.

The present invention may be such that the male housing includes a stopper, and the moving plate includes a stopper receiving portion configured to be locked by the stopper at the protection position and to release a locked state with the stopper when the female housing is lightly fit into the receptacle.

Conventionally, if an attempt is made to rotate a lever toward a connection position with a moving plate at a protection position and male and female housings separated, a cam projection of a moving plate is locked by a cam groove of the lever or the like, whereby an inadvertent drop of the moving plate to a retracted position can be prevented.

However, in the case of the present invention, since the cam projection is accommodated into the escaping space in the process of rotating the lever toward the connection position with the male and female housings separated, the above conventional structure for locking the cam projection by the cam groove of the lever or the like cannot be formed.

In that respect, according to the above configuration, since the stopper of the male housing locks the stopper receiving portion of the moving plate to hold the moving plate at the protection position, it is not necessary to form the above conventional structure for locking the cam projection by the cam groove of the lever or the like. By providing the stopper not on the lever, but on the male housing in this way, the moving plate can be held at the protection position and the tabs can be reliably protected. Further, since the locked state of the stopper and the stopper receiving portion is released when the female housing is lightly fit into the receptacle, the moving plate can move from the protection position to the retracted position without any trouble.

In the present invention, the moving plate may include a peripheral wall portion on an outer periphery of a plate body portion through which the tip parts of the tabs pass, the stopper receiving portion may be provided on the peripheral wall portion and the stopper may be provided on the receptacle. According to this configuration, the plate body portion is not structurally restricted by the stopper receiving portion and a degree of freedom in the arrangement of the tabs and the like can be enhanced.

In the present invention, the stopper may be deflectable and deformable in a direction toward a plate-like arm portion provided in the lever, and the receptacle may include an excessive deflection restricting portion covering the stopper between the stopper and the arm portion. According to this configuration, excessive deflection and deformation of the stopper can be prevented. Further, the interference of the stopper with the lever can be avoided, and a rotating operation of the lever is not hindered.

The present invention may be such that the lever-type connector includes a cam groove formed in the lever, a standby groove formed in the lever, the standby groove communicating with the cam groove, and a cam pin formed on the female housing, the cam pin being displaced to a back side of the cam groove and pressed in a connecting direction by the cam groove as the lever is rotated from the initial position to the connection position in the connection process of the male housing and the female housing, the standby groove is formed to be shallower than the cam groove, the lever is rotated from the initial position toward a side opposite to the connection position to reach a standby position, and the lever is formed with a step between the cam groove and the standby groove for allowing the entrance of the cam projection into the standby groove and restricting the entrance of the cam pin into the standby groove at the standby position. According to this configuration, since the lever can be brought to the standby position, the lever can be disposed in a state capable of avoiding interference with another member at the standby position.

In a conventional case, a cam groove has been provided with a play region where the cam groove is not engaged with a cam projection of a moving plate while a lever is rotated from an initial position to a standby position (see, for example, Japanese Patent Laid-Open Publication No. H11-317255). However, since a cam pin of a female housing conventionally enters the play region, the lever may erroneously rotate from the initial position to the standby position after the female housing is lightly fit into a receptacle. As a result, there has been a concern that the smoothness of a connector connecting operation is impaired.

In that respect, according to the above configuration, the cam pin enters the entrance of the cam groove, but the entrance thereof into the standby groove is restricted by the step with the lever left at the initial position and the female housing lightly fit in the receptacle. Thus, erroneous rotation of the lever from the initial position to the standby position is obstructed at the time of connecting the connector. Therefore, a connector connecting operation can be smoothly and quickly performed. Further, the moving plate is stably held at the protection position by the entrance of the cam projection of the moving plate into the standby groove.

Embodiment

A main structure of one specific embodiment of the present invention is described with reference to FIGS. 1 to 14. Note that, in the following description, a left side in FIGS. 1 to 5 and 7 to 9 is defined as a front side concerning a front-rear direction. Upper and lower sides shown in FIGS. 1 to 14 are directly defined as upper and lower sides concerning a vertical direction. Note that the upper side and a front surface side are synonymous and the lower side and a back surface side are synonymous.

A lever-type connector of this embodiment is summarized. The lever-type connector is provided with a male housing 10 made of synthetic resin and including a tubular receptacle 12 projecting toward the front surface side, and a female housing 40 made of synthetic resin, fittable into the receptacle 12 and formed with a pair of bilaterally symmetrical cam pins 41 on both left and right outer side surfaces. A plurality of male terminal fittings 15 including tabs 17 surrounded by the receptacle 12 is mounted in the male housing 10.

A moving plate 18 made of synthetic resin and movable in the vertical direction between a protection position where tip parts of a plurality of the tabs 17 are positioned by being passed through the moving plate 18 and a retracted position more toward the back surface side (downward of) the protection position. The moving plate 18 is formed with pairs of left and right cam projections 23. A lever 24 made of synthetic resin and rotatable between an initial position and a connection position is mounted on the male housing 10. The lever 24 exhibits a boosting function of connecting the female housing 40 and the male housing 10 by being rotated from the initial position to the connection position while sliding in contact with the cam pins 41.

(Mail Housing 10 and Male Terminal Fitting 15)

Figure 11:
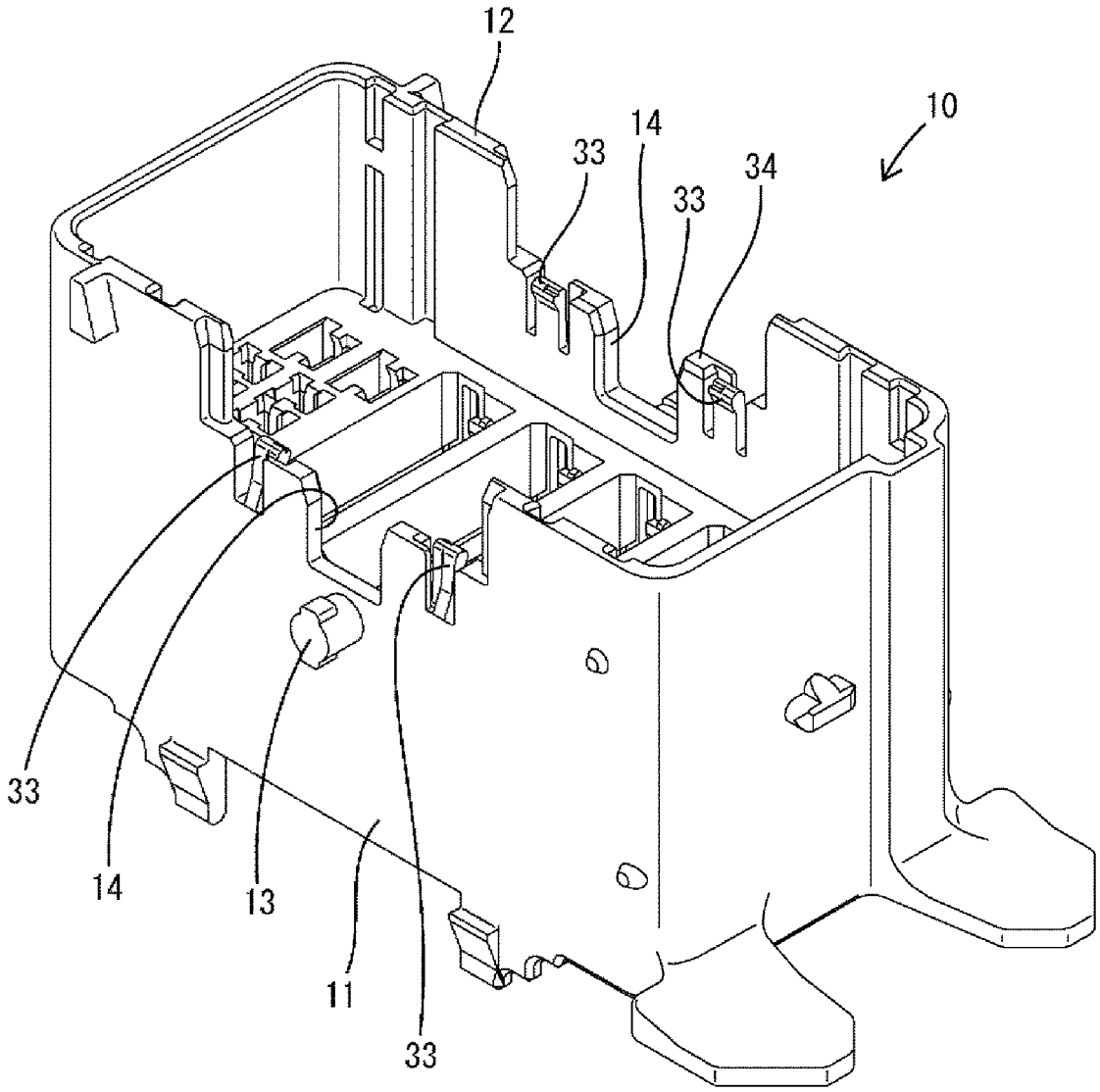
FIG. 11 is a perspective view of the male housing.

As shown in FIG. 11, the male housing 10 includes a block-shaped terminal holding portion 11 and a receptacle 12 in the form of a rectangular tube projecting upward from the outer peripheral edge of the terminal holding portion 11. Terminal body portions 16 of the plurality of male terminal fittings 15 are accommodated in the terminal holding portion 11, and the tabs 17 formed on the tip parts of the male terminal fittings 15 project upward from the terminal holding portion 11 to be accommodated in the receptacle 12. A pair of left and right rotary shafts 13 (center of rotation of the lever 24) are formed on both left and right outer side surfaces of the male housing 10. Further, both left and right outer wall parts of the receptacle 12 are cut downward from upper end edge parts (opening end edge part of the receptacle 12), thereby forming a pair of left and right cutout portions 14.

(Moving Plate 18)

Figure 12:
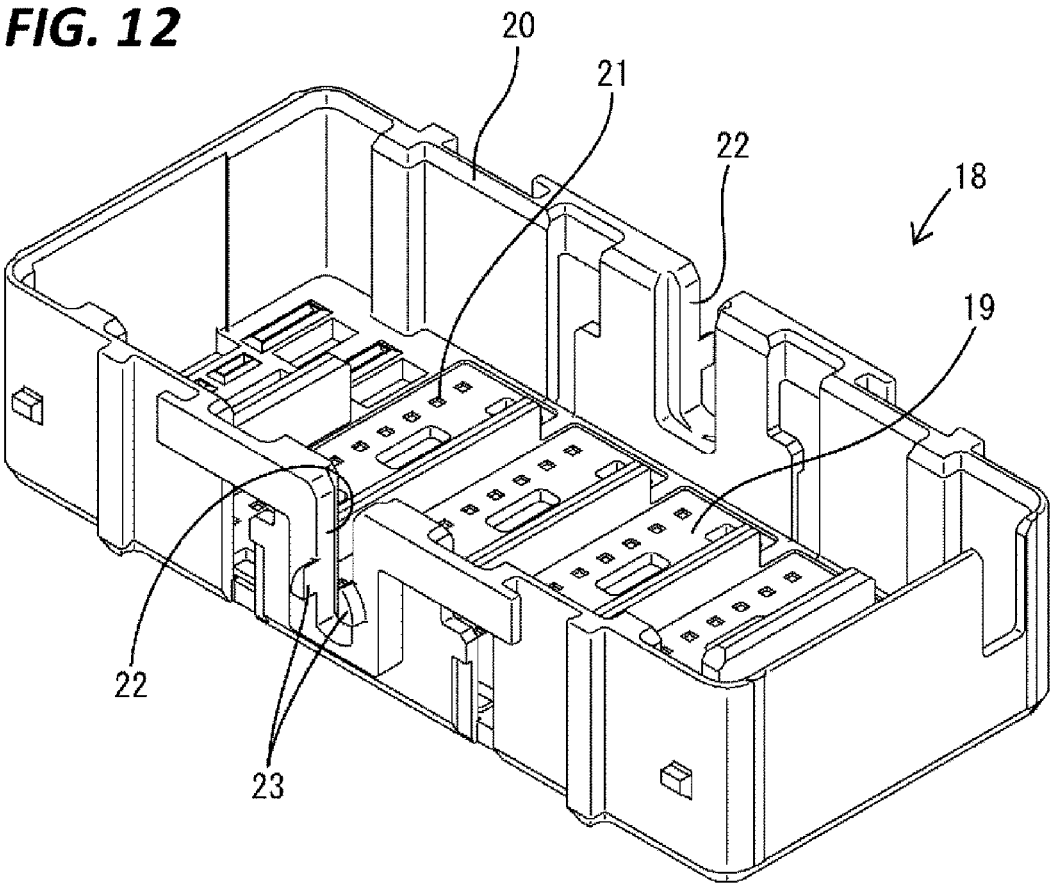
FIG. 12 is a perspective view of a moving plate.
Figure 13:
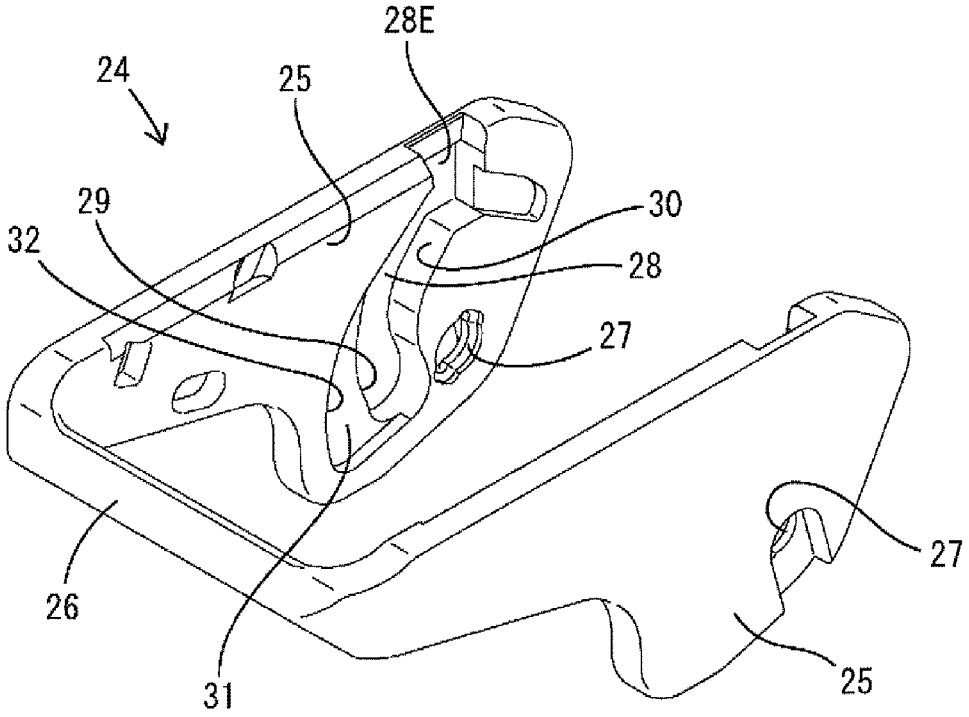
FIG. 13 is a perspective view of the lever.

As shown in FIG. 12, the moving plate 18 is a single component including a plate body portion 19 in the form of a flat plate whose plate thickness direction is oriented to be parallel to a moving direction of the moving plate 18 and a peripheral wall portion 20 projecting upward from the outer peripheral edge of the plate body portion 19. The plate body portion 19 is formed with a plurality of positioning holes 21 for individually positioning the plurality of tabs 17 passed therethrough. Both left and right side wall parts of the peripheral wall portion 20 are cut downward (toward the back surface side) from the upper end edge (opening end edge) of the peripheral wall portion 20, thereby forming a pair of bilaterally symmetrical guide grooves 22.

A pair of front and rear cam projections 23 projecting from a lower end part of a groove edge part of the guide groove 22 are formed on each of both left and right outer side surfaces of the peripheral wall portion 20. With the moving plate 18 accommodated in the receptacle 12, the both cam projections 23 project outwardly of the outer side surface of the receptacle 12 from each cutout portion 14. The cam projections 23 can be accommodated into cam grooves 28 and escaping spaces 31 of the lever 24 to be described later.

The moving plate 18 can move between the protection position (see FIGS. 2 and 3) and the retracted position (see FIG. 7) without being inclined by causing the peripheral wall portion 20 to slide in contact with the inner peripheral surface of the receptacle 12. With the moving plate 18 located at the protection position, tip parts (upper end parts) of the tabs 17 pass through the positioning holes 21 of the plate body portion 19. Thus, upward projecting dimensions of the tabs 17 from the plate body portion 19 are suppressed to be small.

With the moving plate 18 located at the retracted position, base end parts of the tabs 17 pass through the positioning holes 21 since the plate body portion 19 is in contact with or in proximity to the upper end surface of the terminal holding portion 11 (back bottom surface of the receptacle 12). Thus, the upward projecting dimensions of the tabs 17 from the plate body portion 19 are larger than at the protection position.

(Lever 24)

The lever 24 is a single component including a pair of bilaterally symmetrical plate-like arm portions 25 and an operating portion 26 coupling tip parts of the both arm portions 25. Bearing holes 27 penetrating in a lateral direction are formed at positions on base end sides of the both arm portions 25. The lever 24 is mounted on the male housing 10 by fitting the bearing holes 27 to the rotary shafts 13, and rotatable between an initial position (see FIGS. 1, 2, 4 and 8) and a connection position (see FIGS. 3, 5, 7 and 9). With the lever 24 mounted on the male housing 10, the arm portions 25 are disposed to face the outer side surfaces of the receptacle 12 and cover the cutout portions 14.

The lever 24 is formed with a pair of bilaterally symmetrical cam grooves 28 by recessing inner side surfaces of the both arm portions 25. The cam groove 28 has a substantially arcuately curved shape to surround the bearing hole 27 (center of rotation of the lever 24), and an entrance 28E of the cam groove 28 is open in the outer peripheral edge of the arm portion 25. A radial distance from the bearing hole 27 to the cam groove 28 is longest at the entrance 28E of the cam groove 28 and shortest at a back end part of the cam groove 28.

In a connection process and a separation process of the both housings 10, 40, the cam projections 23 of the moving plate 18 and the cam pins 41 of the female housing 40 relatively move in the cam grooves 28. Out of the inner side surface of the cam groove 28, a part on an outer side facing the bearing hole 27 (rotary shaft 13) functions as a connecting can surface 29. A part of the inner side surface on an inner side back to back with the bearing hole 27 (rotary shaft 13) functions as a separating cam surface 30. The separating cam surface 30 is disposed at a position closer to the rotary shaft 13 than the connecting cam surface 29.

The lever 24 is formed with a pair of bilaterally symmetrical escaping spaces 31 by recessing the inner side surfaces of the both arm portions 25. In the process of rotating the lever 24 between the initial position and the connection position with the both housings 10, 40 separated, the cam projections 23 are relatively displaced in the escaping spaces 31. A depth of the escaping space 31 from the inner side surface of the arm portion 25 (dimension parallel to an axis of the rotary shaft 13) is set smaller than a depth of the cam groove 28. Thus, the connecting cam surface 29 is disposed in a region backward of the escaping space 31 in depth directions of the cam groove 28 and the escaping space 31.

An entrance depth of the cam projections 23 into the escaping space 31 is set equal to or slightly smaller than the depth of the escaping space 31. When the cam projections 23 move in the escaping space 31, projecting end surfaces (left end surfaces in FIG. 6) of the cam projections 23 are kept out of contact with the inner side surface of the escaping space 31 or slides in light contact with the inner side surface of the escaping space 31. Further, the separating cam surface 30 is disposed in the same depth region as the escaping space 31 in the depth directions of the cam groove 28 and the escaping space 31. Thus, the outer peripheral surfaces of the cam projections 23 and the outer peripheral surface of the cam pin 41 to be described later can slide in contact with the separating cam surface 30. However, the cam pin 41 to be described later can slide in contact with the connecting cam surface 29, but the cam projections 23 cannot contact the connecting cam surface 29.

The escaping space 31 is disposed in a region more distant from the rotary shaft 13 than the connecting cam surface 29 and the separating cam surface 30 in the inner side surface of the arm portion 25. The escaping space 31 communicates with the cam groove 28 over the entire region from an entrance 31E to a back end thereof. That is, the entrance 31E of the escaping space 31 is adjacent to and communicates with the entrance 28E of the cam groove 28. Further, the escaping space 31 is adjacent to the connecting cam surface 29 in a radial direction (direction orthogonal to the rotary shaft 13 and intersecting a rotating direction of the lever 24).

The arm portion 25 is formed with a restricting surface 32 radially facing the rotary shaft 13. The restricting surface 32 is formed along the outer peripheral edge of the escaping space 31 and over the entire region from the entrance 31E to the back end of the escaping space 31. A region of the restricting surface 32 backward of the entrance 31E of the escaping space 31 has a substantially arcuate shape concentric with the rotary shaft 13. A radial distance between the substantially arcuate region of the restricting surface 32 and a center of the rotary shaft 13 is set longer than a distance from the center of rotary shaft 13 to the upper ends of the cam projections 23 (parts of the cam projections 23 most distant from the rotary shaft 13). In this way, the cam projections 23 are kept out of contact with the restricting surface 32 in the entire process of relatively moving the cam projections 23 in the escaping space 31.

(Female Housing 40)

The female housing 40 is block-shaped as a whole and fittable into the moving plate 18 (receptacle 12). A plurality of female terminal fittings 42 are accommodated in the female housing 40. The pair of bilaterally symmetrical cam pins 41 are formed to project on both left and right outer side surfaces of the female housing 40. If the female housing 40 is fit into the moving plate 18, each cam pin 41 and the pair of cam projections 23 can be united with the cam pin 41 sandwiched in the front-rear direction between the pair of cam projections 23. The cam pin 41 and the pair of cam projections 23 are relatively displaceable in the vertical direction (direction parallel to a connecting/separating direction of the both housings 10, 40) in a united state.

Figure 10:
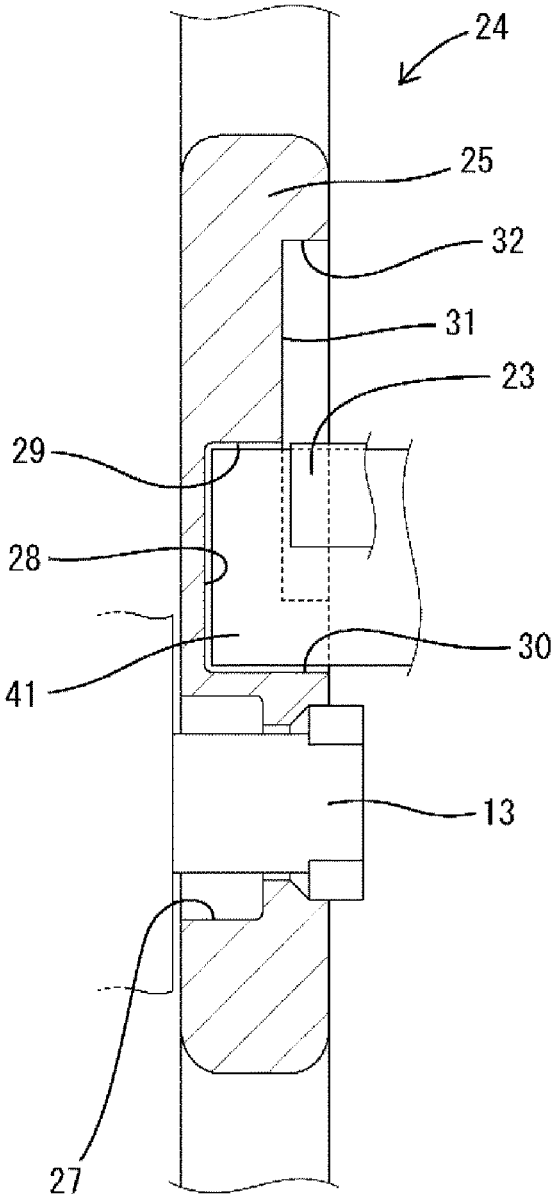
FIG. 10 is a section along Y-Y of FIG. 9.

With the cam pin 41 and the cam projections 23 united, a projecting end of the cam pin 41 projects laterally (direction parallel to the axis of the rotary shaft 13) from projecting ends of the cam projections 23 as shown in FIG. 10. Further, since a vertical dimension of the cam pin 41 is set larger than those of the cam projections 23, at least one of upper and lower end parts of the cam pin 41 projects upwardly or downwardly of the cam projections 23 with the cam pin 41 and the cam projections 23 united.

Further, in the connection/separation process of the male housing 10 and the female housing 40, a large load due to sliding resistance or the like does not act on the moving plate 18. Thus, the cam projections 23 are shaped and dimensioned to be relatively low in rigidity and strength. In contrast, since a large sliding resistance due to resilient contact between the male terminal fittings 15 and the female terminal fittings 42 is generated between the male housing 10 and the female housing 40, large loads act on the cam pin 41 from the lever 24. Thus, the cam pins 41 are shaped and dimensioned to have higher rigidity and strength than the cam projections 23.

(Functions and Effects)

Figure 4:
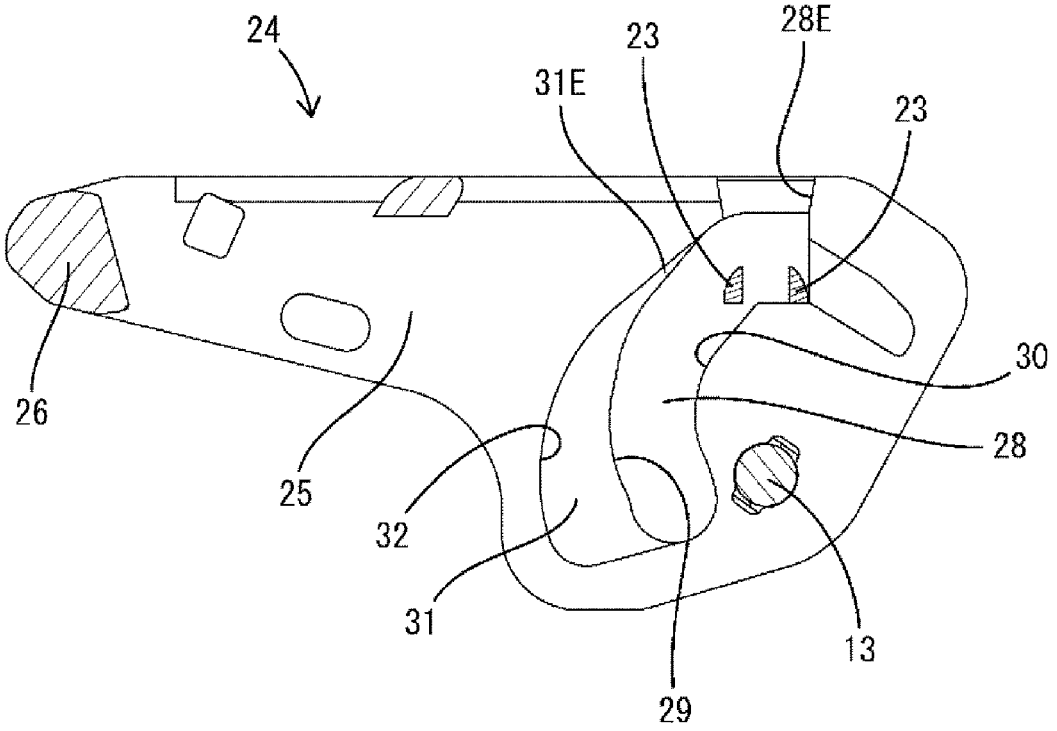
FIG. 4 is a side view in section showing a positional relationship of cam projections, a cam groove and an escaping space with the male and female housings separated and the lever located at the initial position.
Figure 5:
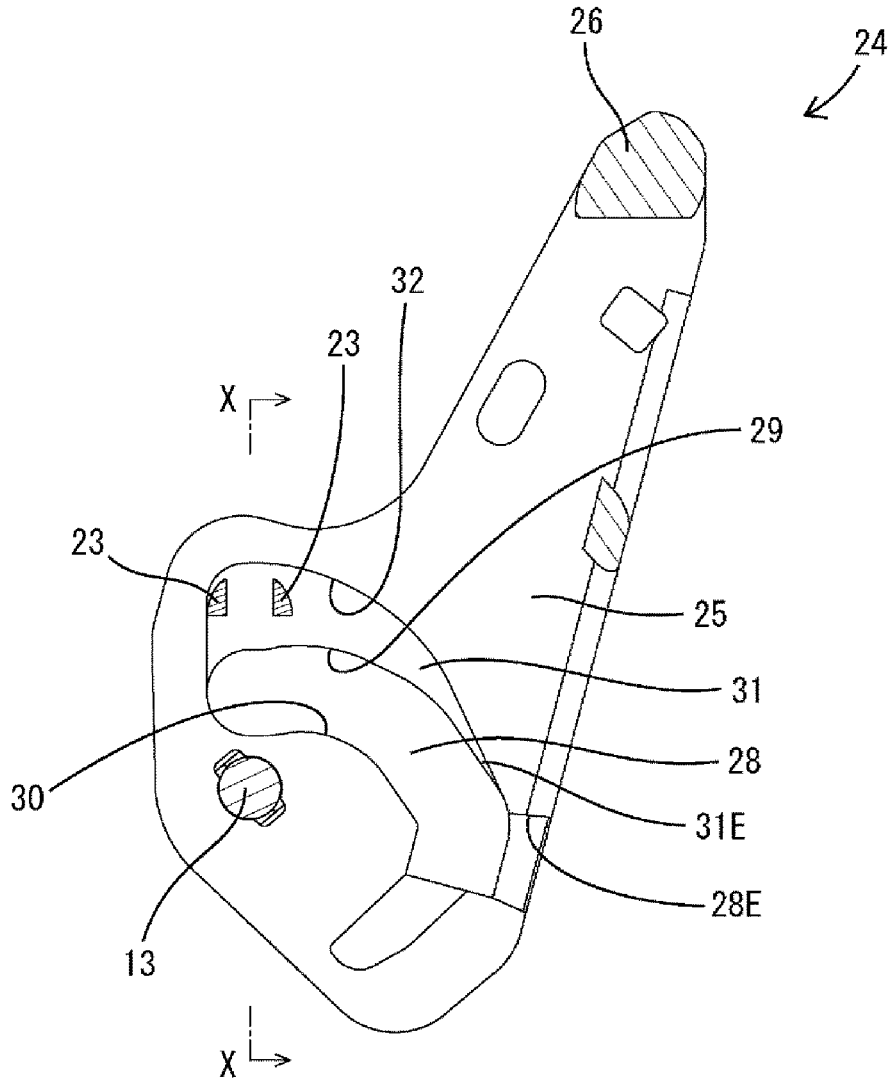
FIG. 5 is a side view in section showing a positional relationship of the cam projections, the cam groove and the escaping space with the male and female housings separated and the lever located at the connection position.
Figure 6:
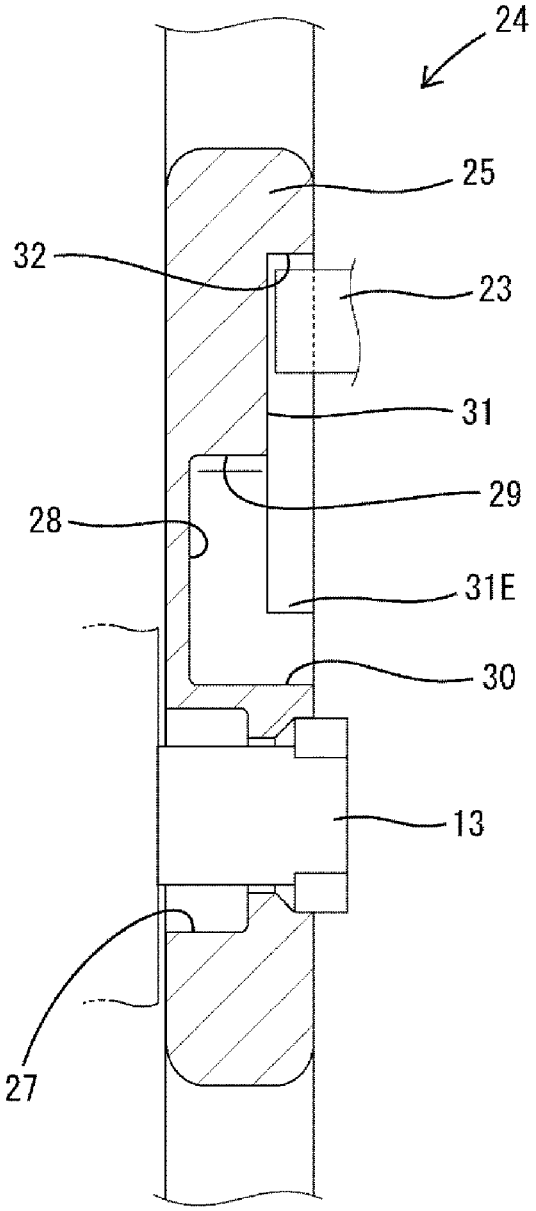
FIG. 6 is a section along X-X of FIG. 5.
Figure 7:
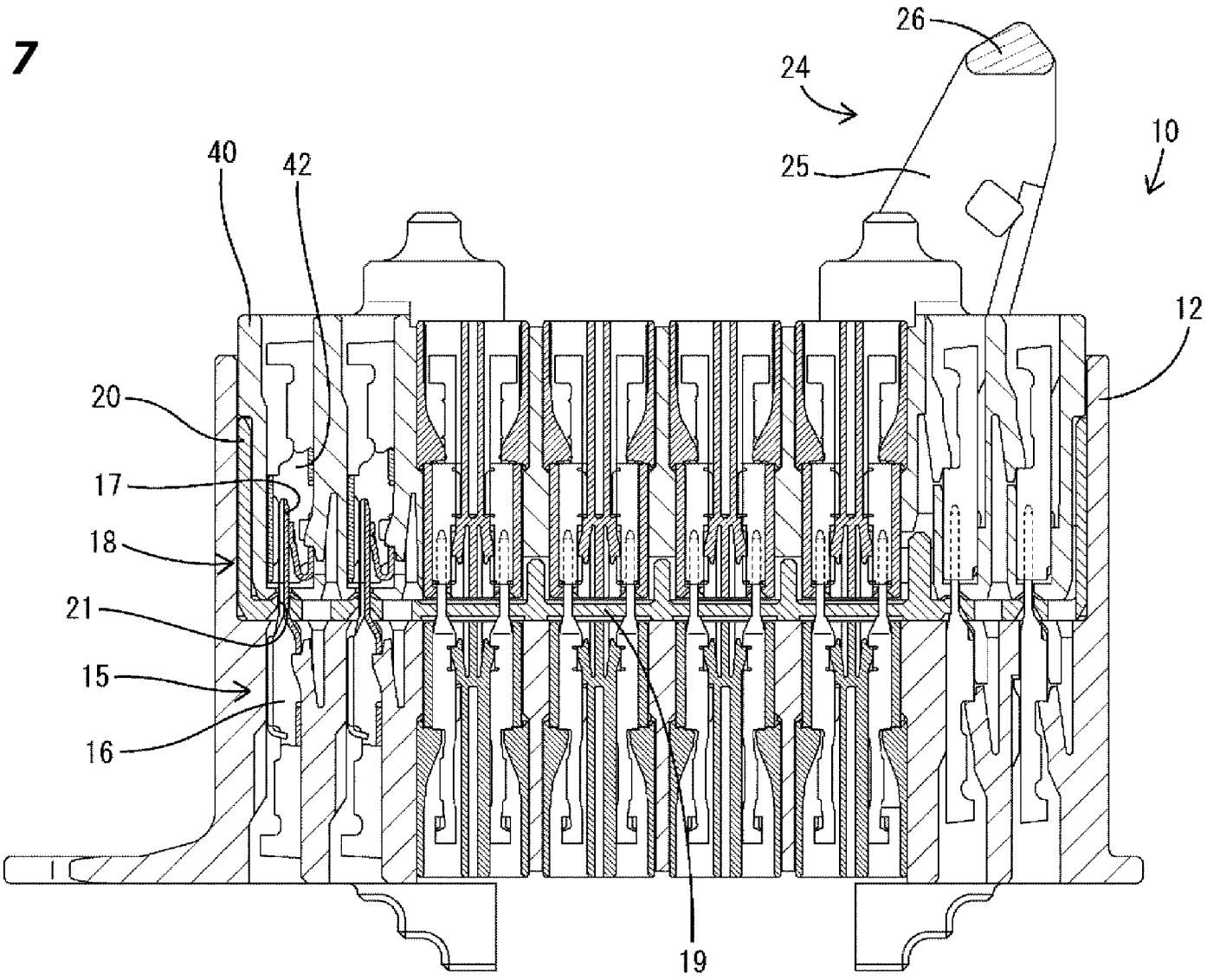
FIG. 7 is a side view in section showing a state where the male and female housings are connected.

With the male housing 10 and the female housing 40 separated and the lever 24 located at the initial position (see FIG. 2), the entrances 28E of the cam grooves 28 and the entrances 31E of the escaping spaces 31 are open upward and the cam projections 23 are located in contact with or in proximity to the back end surfaces of the entrances 28E of the cam grooves 28 as shown in FIG. 4. When the cam projections 23 are located at the entrances 28E of the cam grooves 28, the moving plate 18 is at the protection position. The moving plate 18 at the protection position is locked by stoppers 33 formed on the receptacle 12, whereby a movement to the retracted position is restricted (described in detail in (Detailed Mode 1) next).

Figure 8:
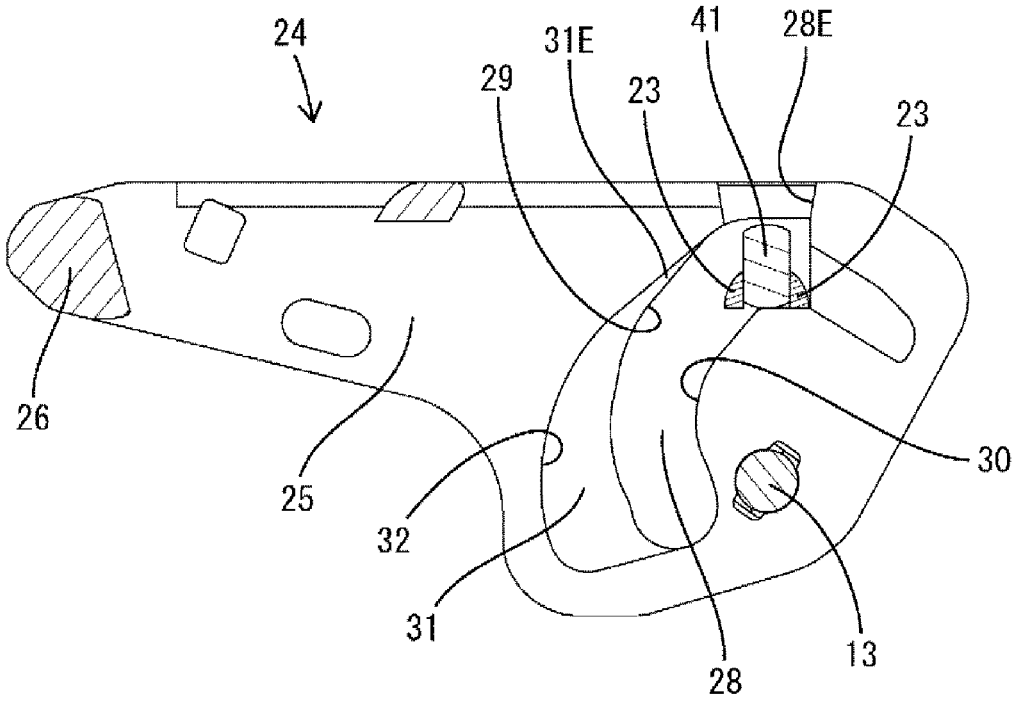
FIG. 8 is a side view in section showing a positional relationship of the cam projections, a cam pin, the cam groove and the escaping space with the connection of the male and female housings started and the lever located at the initial position.

If the female housing 40 is lightly fit into the receptacle 12 from this state, the female housing 40 is fit into the peripheral wall portion 20 of the moving plate 18 to approach the upper surface of the plate body portion 19, i.e. face the upper surface without contacting the upper surface. Note that the female housing 40 may come into contact with the upper surface of the plate body portion 19 at this time. As the female housing 40 is lightly fit into the moving plate 18, each cam pin 41 enters the entrance 28E of the cam groove 28 and is inserted into between the pair of cam projections 23, whereby the cam pin 41 and the cam projections 23 are united. At this time, as shown in FIG. 8, the cam pin 41 is in contact with the back end surface of the entrance 28E and the upper end part (rear end part in the connecting direction of the female housing 40) of the cam pin 41 projects upwardly of the cam projections 23.

Further, since the female housing 40 displaces the stoppers 33, the moving plate 18 can move to the retracted position. If the lever 24 at the initial position is rotated toward the connection position from this state, the cam pins 41 slide in contact with the separating cam surfaces 29 of the cam grooves 28 to exhibit the boosting action, wherefore the female housing 40 is pulled toward the male housing 10 to proceed with the connection.

In an initial stage of the connection process of the both housings 10, 40 (rotation process of the lever 24), only the female housing 40 is moved downward (connecting direction) since the separating cam surfaces 29 press the upper end parts of the cam pins 41. Since the separating cam surfaces 29 do not contact the cam projections 23 during this time, the moving plate 18 does not move from the protection position. When being slightly moved, the female housing 40 comes into surface contact with the upper surface of the plate body portion 19.

Thereafter, as the lever 24 is further rotated, the moving plate 18 is pushed by the female housing 40 and pushed to the back side (lower side) of the receptacle 12 integrally with the female housing 40. When the lever 24 reaches the connection position, the both housings 10, 40 are properly connected and the tabs 17 of the male terminal fittings 15 enter the female housing 40 to be connected to the female terminal fittings 42.

Since the cam projections 23 and the separating cam surfaces 29 are kept out of contact until the lever 24 is rotated to the connection position after the female housing 40 comes into surface contact with the plate body portion 19, a vertical positional relationship of the moving plate 18 and the female housing 40 does not change. Thus, the female housing 40 and the plate body portion 19 are kept in surface contact with each other.

As just described, in the process of rotating the lever 24 from the initial position to the connection position, only the female housing 40 moves in an initial stage of rotation, whereby the moving plate 18 and female housing 40 are in contact with and integrated with each other. Thereafter, the female housing 40 is connected to the male housing 10 while being kept integrated with the moving plate 18 until the connection position is reached.

Further, in a state where the upper ends of the cam projections 23 and those of the cam pins 41 are substantially at the same position in the vertical direction and the lever 24 is moving to or located at the connection position, the upper end parts of the cam projections 23 may be located higher than the connecting cam surfaces 29. Thus, there is a concern that the upper end parts of the cam projections 23 interfere with the lever 24. However, since the escaping spaces 31 are disposed above and adjacent to the connecting cam surfaces 29, the cam projections 23 avoid interference with the lever 24 by the upper end parts (parts) thereof entering the escaping spaces 31.

When the lever 24 at the connection position is rotated to the initial position from a state where the both housings 10, 40 are connected, the separating cam surfaces 30 slide in contact with the cam projections 23 and the cam pins 41, whereby the moving plate 18 at the retracted position is pushed upward (toward the opening end side of the receptacle 12) and moved to the protection position and the female housing 40 is pushed upward and separated from the male housing 10.

Figure 9:
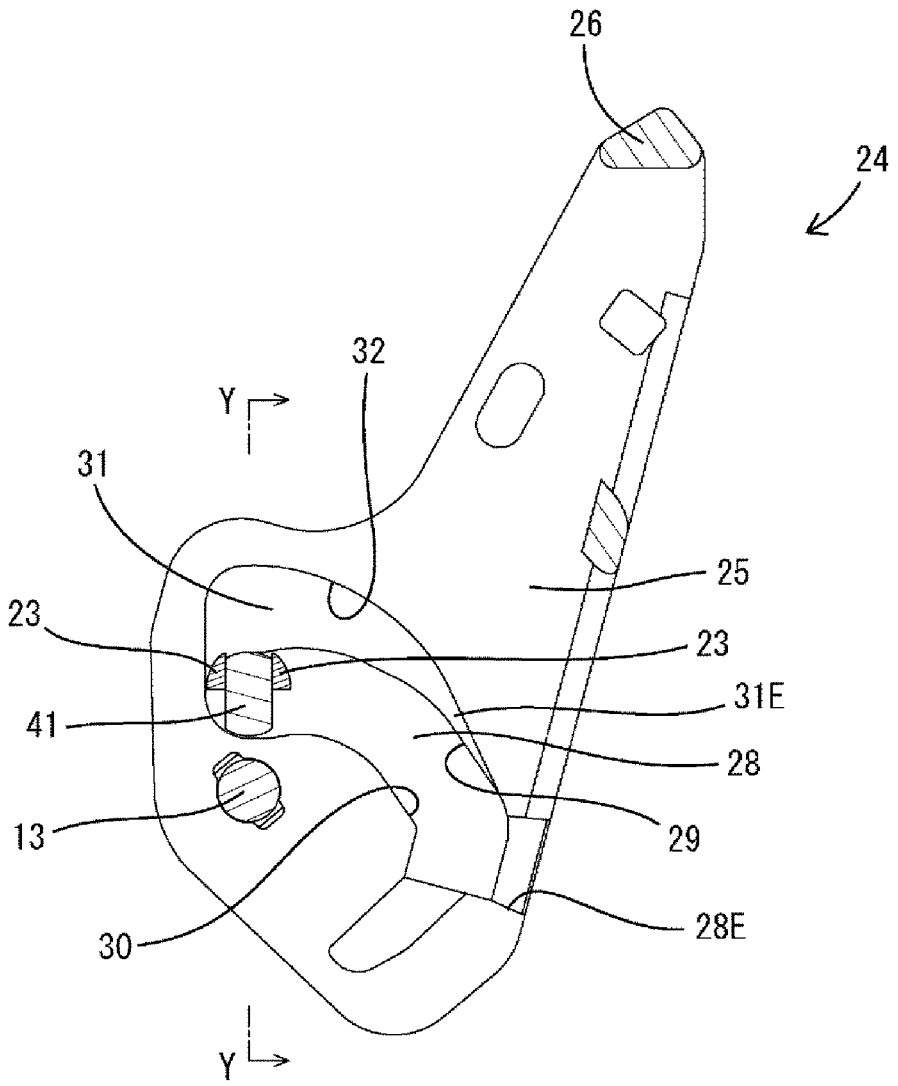
FIG. 9 is a side view in section showing a positional relationship of the cam projections, the cam pin, the cam groove and the escaping space with the male and female housings connected and the lever located at the connection position.

Specifically, with the both housings 10, 40 connected, the cam projections 23 are largely separated from the separating cam surfaces 30, whereas the lower end parts of the cam pins 41 project downward from the lower ends of the cam projections 23 and are in contact with or in proximity to the separating cam surfaces 30 as shown in FIG. 9. Thus, in an initial stage of the rotation of the lever 24 toward the initial position, the separating cam surfaces 30 slide in contact with only the lower end parts of the cam pins 41 and the female housing 40 is pushed upward and separated from the plate body portion 19. During this time, the moving plate 18 does not move and the cam pins 41 relatively move upward with respect to the cam projections 23.

If the lever 24 is further rotated after the female housing 40 is separated from the plate body portion 19, the separating cam surfaces 30 start to slide in contact with the lower end parts of the cam projections 23. Thereafter, until the lever 24 reaches the initial position, the separating cam surfaces 30 slide in contact with both the cam projections 23 and the cam pins 41 and both the moving plate 18 and the female housing 40 move upward. When the lever 24 returns to the initial position, the cam pins 41 and the cam projections 23 return to the entrances 28E of the cam grooves 28. Thus, the both housings 10, 40 can be separated if the female housing 40 is lifted up.

Note that if an attempt is made to cause the separating cam surfaces 30 to slide in contact with only the cam projections 23 in the process of rotating the lever 24 from the connection position to the initial position, the female housing 40 is pushed in the separating direction by the plate body portion 19. In this case, since loads equivalent to a large separation resistance between the female housing 10 and the female housing 40 act on the cam projections 23, the cam projections 23 need to have a high strength by being enlarged. If the cam projections 23 are enlarged, the escaping spaces 31 also need to be made larger. If the escaping space 31 are made larger, thin regions in the lever 24 are enlarged, which is not preferable in terms of strength.

To avoid this, in this embodiment, the separating cam surfaces 30 are caused to slide in contact with only the cam pins 41 and the female housing 40 is separated from the plate body portion 19 in the initial stage of the rotation process of the lever 24 from the connection position to the initial position. Thereafter, the separating cam surfaces 30 are caused to slide in contact with both the cam projections 23 and the cam pins 41 and the female housing 40 and the plate body portion 19 are moved in the separating direction while being separated until the lever 24 reaches the initial position after the separating cam surfaces 30 start to slide in contact with the cam projections 23. In this way, the miniaturization of the cam projections 23 could be realized.

Although a contact region of the separating cam surface 30 with the cam projections 23 and the cam pin 41 is oblique to the connecting/separating direction, an angle of inclination of the contact region of the separating cam surface 30 changes in the rotation process of the lever 24. In addition, the cam projections 23 and the cam pin 41 are disposed side by side in a direction intersecting the connecting/separating direction. Thus, a moving distance of the female housing 40 and a moving distance of the moving plate 18 are slightly different when the lever 24 is rotated by a certain angle, but the female housing 40 and the plate body portion 19 are kept sufficiently spaced apart. Therefore, there is no possibility that the female housing 40 and the plate body portion 19 interfere with each other in the rotation process of the lever 24.

Further, if the both housings 10, 40 are separated and the lever 24 is returned to the initial position, the moving plate 18 returns to the protection position. Since the operating portion 26 of the lever 24 is at a position deviated forward of an opening region of the receptacle 12 in this state, the entire region of the upper end of the receptacle 12 is open. However, since the upward projecting dimensions of the tabs 17 from the plate body portion 19 are relatively small with the moving plate 18 located at the protection position, there is no possibility that an external matter interferes with the tabs 17.

In the lever-type connector of this embodiment, the lever 24 is rotated from the initial position to the connection position with the both housings 10, 40 separated, such as when the male housing 10 is mounted on another member. If the connecting cam surfaces 29 of the lever 24 press the cam projections 23 when the lever 24 is rotated to the connection position, the moving plate 18 drops to the retracted position to increase the projecting dimensions of the tabs 17 from the plate body portion 19, whereby the tabs 17 may be deformed due to the interference of the other member.

However, since the cam projections 23 do not interfere with the connecting cam surfaces 29 in the lever-type connector of this embodiment, a pressing force does not act on the cam projections 23 in the connecting direction from the lever 24. Further, the separating cam surfaces 30 become more distant from the cam projections 23 according to the rotation of the lever 24 toward the connection position. Thus, if the lever 24 is rotated from the initial position to the connection position with the both housings 10, 40 separated, the cam projections 23 enter the escaping spaces 31 and are relatively displaced in a circumferential direction in the escaping spaces 31. Since the cam projections 23 are kept out of interference with the lever 24 (do not receive any pressing force in the radial and circumferential directions from the lever 24) while the cam projections 23 are relatively displaced in the escaping spaces 31, the moving plate 18 is held at the protection position.

Further, if the lever 24 is rotated to the initial position after being rotated to the connection position with the both housings 10, 40 separated, the cam projections 23 are relatively displaced in the escaping spaces 31 and return to the entrances 28E of the cam grooves 28. Since neither the separating cam surfaces 30 nor the connecting cam surfaces 29 contact the cam projections 23 during this time, the moving plate 18 is kept at the protection position.

In the lever-type connector of this embodiment, the lever 24 is formed with the connecting cam surfaces 29 and the escaping spaces 31. The connecting cam surfaces 29 press the cam pins 41 in the connecting direction while being kept out of contact with the cam projections 23 in the process of rotating the lever 24 from the initial position to the connection position. Further, in the process of rotating the lever 24 from the initial position to the connection position with the both housings 10, 40 separated and the moving plate 18 located at the protection position, the cam projections 23 are accommodated into the escaping spaces 31 while being kept out of contact with the connecting cam surfaces 29.

According to this configuration, since the connecting cam surfaces 29 do not contact the cam projections 23 in the escaping spaces 31, a pressing force in the connecting direction does not act on the moving plate 18. In this way, the moving plate 18 can be held at the protection position. Further, the cam grooves 28 function not only as spaces for displacing the cam projections 23, but also as spaces for displacing the cam pins 41. Thus, the shape of the lever 24 can be simplified as compared to the case where dedicated passages for displacing the cam pins 41 in the connection process of the both housings 10, 40 are formed separately from the cam grooves 28.

In the lever-type connector of this embodiment, the lever 24 is formed with the cam grooves 28. The cam groove 28 is curved to approach the rotary shaft 13 (center of rotation of the lever 24) from the entrance 28E toward the back side. In the process of rotating the lever 24 from the initial position to the connection position while the lever 24 is sliding in contact with the cam pins 41, the cam grooves 28 function as first passages enabling the cam projections 23 to be displaced toward the rotary shafts 13.

The lever 24 is also formed with the escaping spaces 31. In the process of rotating the lever 24 from the initial position to the connection position while the lever 24 is kept out of contact with the cam pins 41, the escaping spaces 31 function as second passages for allowing the cam projections 23 to be displaced without changing a positional relationship with the rotary shafts 13. Thus, if the lever 24 is rotated from the initial position to the connection position with the both housings 10, 40 separated and the lever 24 kept out of contact with the cam pins 41, the cam projections 23 are displaced in the escaping spaces 31 while being kept at a distance from the center of rotation of the lever 24. Therefore, the moving plate 18 also does not move from the protection position.

In the lever-type connector of this embodiment, the lever 24 is formed with the separating cam surfaces 30 and the escaping spaces 31 disposed in the regions more distant from the rotary shafts 13 than the separating cam surfaces 30. In the process of rotating the lever 24 at the connection position to the initial position with the both housings 10, 40 connected, the separating cam surfaces 30 press the cam projections 23 in directions away from the rotary shafts 13, whereby the both housings 10, 40 are separated. Further, in the process of rotating the lever 24 from the initial position to the connection position with the both housings 10, 40 separated and the moving plate 18 located at the protection position, the cam projections 23 are accommodated into the escaping spaces 31 while being separated from the separating cam surfaces 30.

According to this configuration, the cam projections 23 are pushed by the separating cam surfaces 30 with the both housings 10, 40 separated, thereby being disposed at positions most distant from the rotary shafts 13 for the lever 24 in the cam grooves 28. The escaping spaces 31 are disposed in the regions more distant from the rotary shafts 13 than the separating cam surfaces 30. Thus, in the process of rotating the lever 24 toward the connection position with the both housings 10, 40 separated, the cam projections 23 accommodated in the escaping spaces 31 do not approach the rotary shafts 13. In this way, the moving plate 18 is held at the protection position.

In the lever-type connector of this embodiment, the female housing 40 is formed with the cam pins 41. With the female housing 40 fit in the receptacle 12 and the cam pins 41 and the cam projections 23 united, projecting dimensions of the cam pins 41 from the outer side surfaces of the male housing 10 are larger than those of the cam projections 23 from the outer side surfaces of the male housing 10. On the other hand, the lever 24 is formed with the cam grooves 28 for accommodating the cam projections 23 and the cam pins 41 in the connection/separation process of the both housings 10, 40. The lever 24 is also formed with the escaping spaces 31 restricting the entrance of the cam pins 41 by being less recessed than the cam grooves 28. The escaping spaces 31 are less recessed than the cam grooves 28.

In the process of rotating the lever 24 from the initial position to the connection position with the both housings 10, 40 separated and the moving plate 18 located at the protection position, the cam projections 23 are accommodated into the escaping spaces 31 without interfering with the lever 24. Thus, a pressing force in the connecting direction does not act on the moving plate 18, wherefore the moving plate 18 can be held at the protection position. Further, in the connection process of the both housings 10, 40, erroneous entrance of the cam pins 41 into the escaping spaces 31 is prevented.

Further, the lever 24 is formed with the cam grooves 28 capable of accommodating the cam projections 23 and the cam pins 41 in the connection process of the both housings 10, 40, and these cam grooves 28 are formed with the connecting cam surfaces 29. The escaping spaces 31 are adjacent to the connecting cam surfaces 29 and communicate with the cam grooves 28. Since the escaping spaces 31 communicate with the cam grooves 28, the cam projections 23 and the cam pins 41 can be moved in the state unite in the cam grooves 28 in the connection process of the both housings 10, 40. Further, since the cam grooves 28 double as movement paths for the cam projections 23 in the connection process of the both housings 10, 40, the shape of the lever 24 can be simplified as compared to the case where movement paths exclusively for the cam projections 23 are formed in the lever 24 separately from the cam grooves 28.

Further, the escaping spaces 31 are disposed in the regions more distant from the rotary shafts 13 than the connecting cam surfaces 29. According to this configuration, in the process of rotating the lever 24 from the initial position to the connection position with the both housings 10, 40 separated, the cam projections 23 do not approach the center of rotation of the lever 24, wherefore the moving plate 18 can be held at the protection position.

The lever 24 is formed with the separating cam surfaces 30. In the process of separating the both housings 10, 40 by rotating the lever 24 toward the initial position from the state where the both housings 10, 40 are connected, the separating cam surfaces 30 press the cam projections 23, thereby moving the moving plate 18 toward the protection position. According to this configuration, if the lever 24 is rotated from the connection position to the initial position with the both housings 10, 40 connected, the separating cam surfaces 30 press the cam projections 23 to move the moving plate 18 to the protection position. In the process of moving the moving plate 18 to the protection position, the both housings 10, 40 are separated.

The female housing 40 is formed with the cam pins 41 to be pressed in the connecting direction by the cam grooves 28 as the lever 24 is rotated from the initial position to the connection position in the connection process of the both housings 10, 40. The escaping spaces 31 communicate with the cam grooves 28 and the cam grooves 28 are formed with the separating cam surfaces 30. According to this configuration, the cam grooves 28 serve as both the movement paths for the cam pins 41 in the connection process of the both housings 10, 40 and the movement paths for the cam projections 23 in the separation process of the both housings 10, 40. Therefore, the shape of the lever 24 can be simplified as compared to the case where separation movement spaces exclusive for the cam projections 23 are formed in the lever 24 separately from the cam grooves 28.

Further, the entrances 31E of the escaping spaces 31 are adjacent to and communicate with the entrances 28E of the cam grooves 28, and the escaping spaces 31 are disposed in the regions more distant from the rotary shafts 13 than the cam grooves 28 in regions of the cam grooves 28 and the escaping spaces 31 backward of the entrances 28E, 31E. According to this configuration, since the entrances 28E of the cam grooves 28 and the entrances 31E of the escaping spaces 31 are adjacent to and communicate with each other, the shape of the lever 24 can be simplified as compared to the case where the entrances 28E of the cam grooves 28 and the entrances 31E of the escaping spaces 31 are separate spaces not communicating with each other.

Further, the lever 24 is formed with the restricting surfaces 32 disposed to face the rotary shafts 13 and extend along the outer peripheral edges of the escaping spaces 31. According to this configuration, the cam projections 23 come into contact with the restricting surfaces 32, whereby the moving plate 18 at the protection position can be prevented from moving to a side opposite to the retracted position and separating from an opening in the front surface of the receptacle 12. Note that, in the process of rotating the lever 24 between the initial position and the connection position with the both housings 10, 40 separated, the cam projections 23 being relatively displaced in the escaping spaces 31 are kept out of contact with the restricting surfaces 32, wherefore there is no possibility that the moving plate 18 at the protection position drops toward the retracted position.

(Detailed Mode 1)

Next, detailed structures and functions of the stoppers 33 and parts relating to the stoppers 33 are described mainly with reference to FIGS. 15 to 21.

Figure 14:
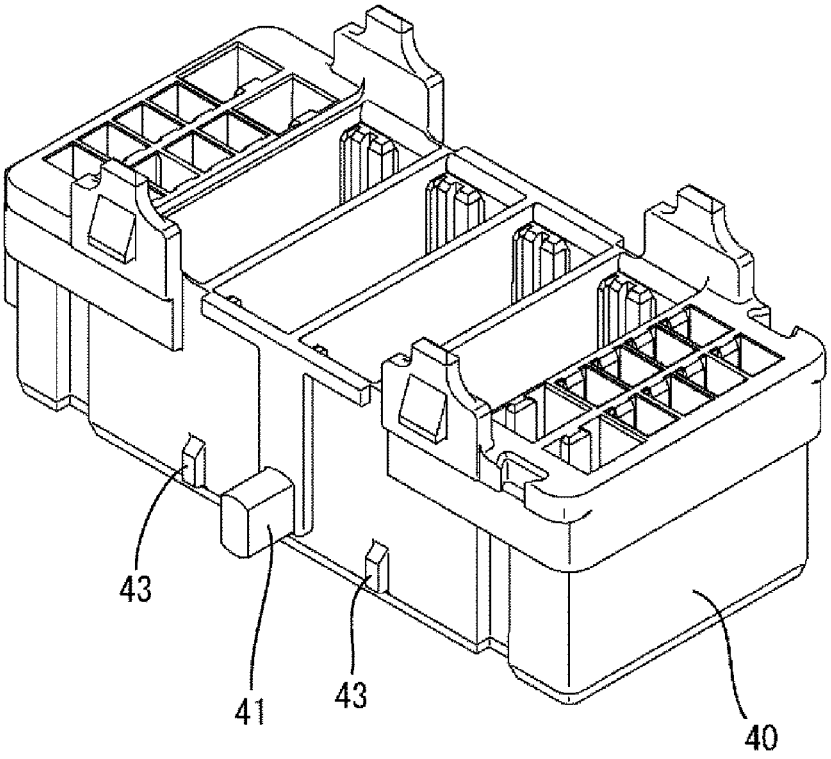
FIG. 14 is a perspective view of the female housing.

A pair of releasing portions 43 are formed to project on both front and rear sides across the cam pin 41 on each of both left and right outer side surfaces of the female housing 40 (see FIG. 14). The releasing portions 43 are in the form of ribs elongated in the vertical direction and formed to have a smaller projecting dimension than the cam pin 41.

Figure 15:
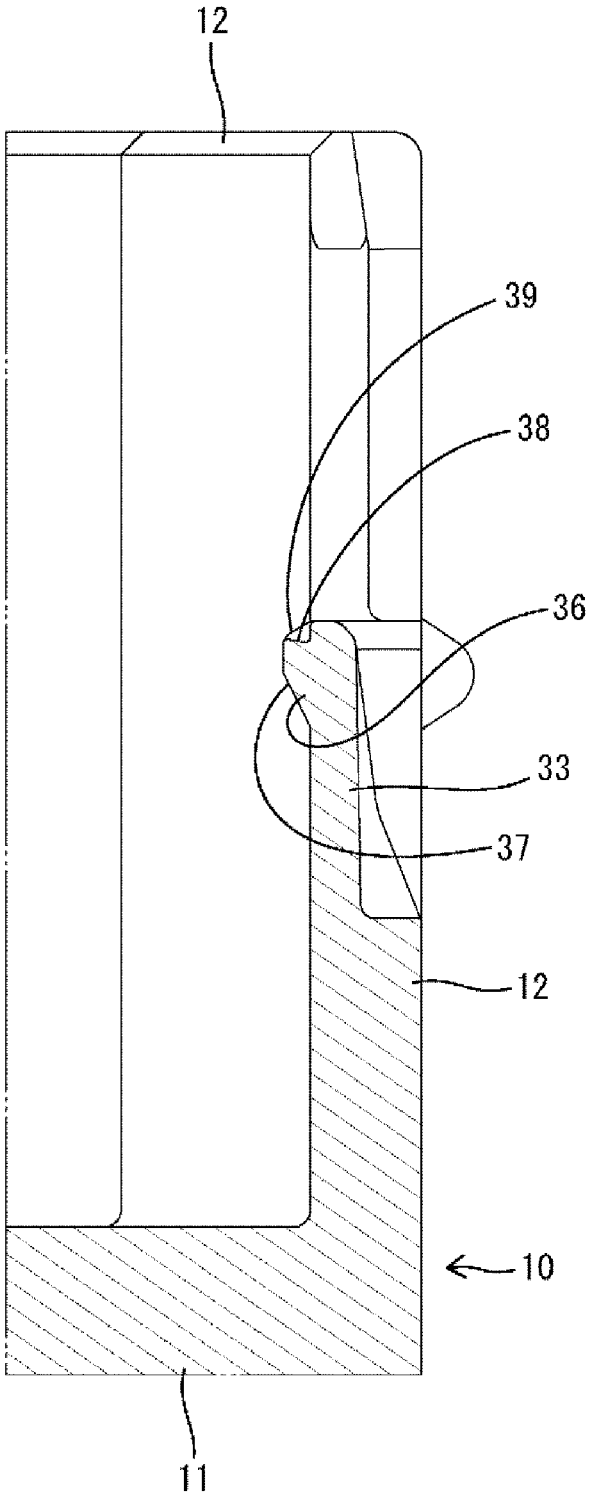
FIG. 15 is a plan view in section of a stopper of the male housing.
Figure 16:
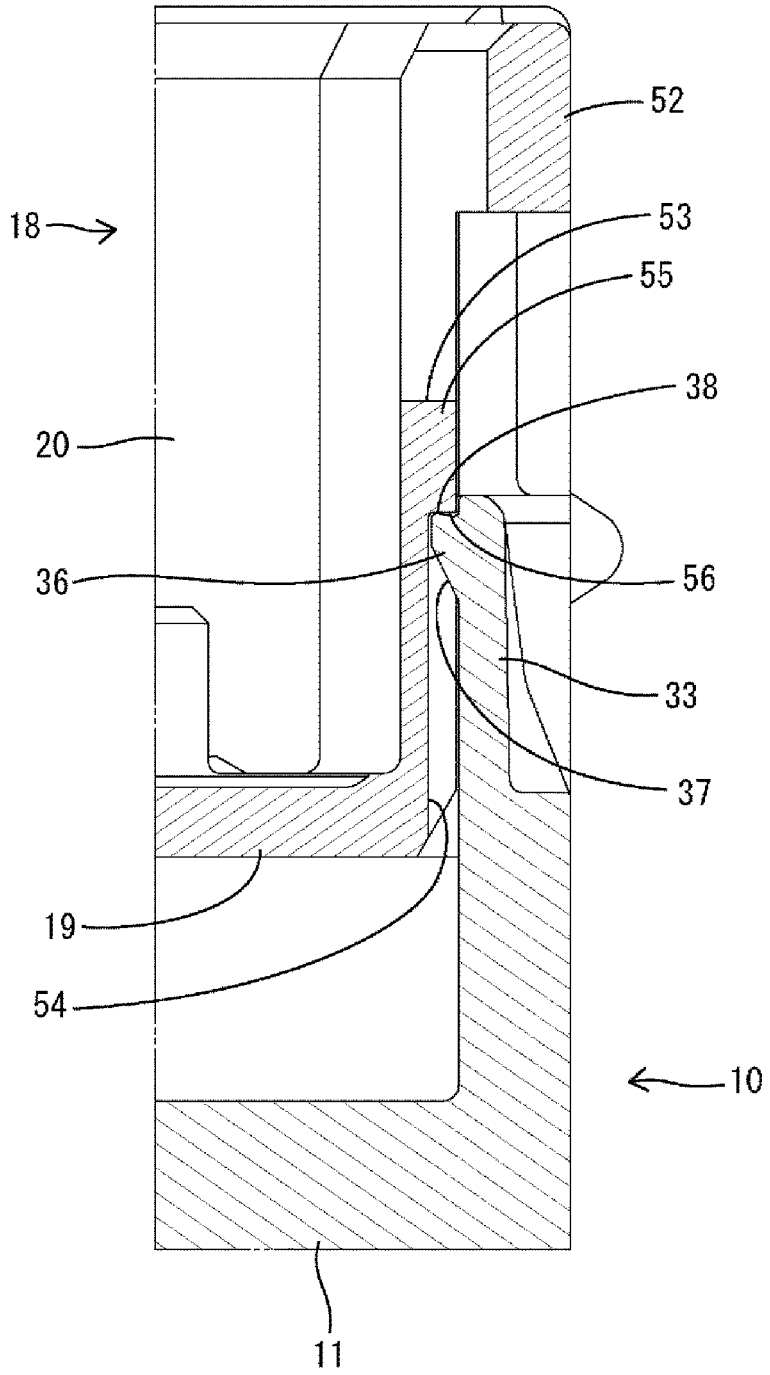
FIG. 16 is a plan view in section showing a state where the stopper is locking a stopper receiving portion.
Figure 17:
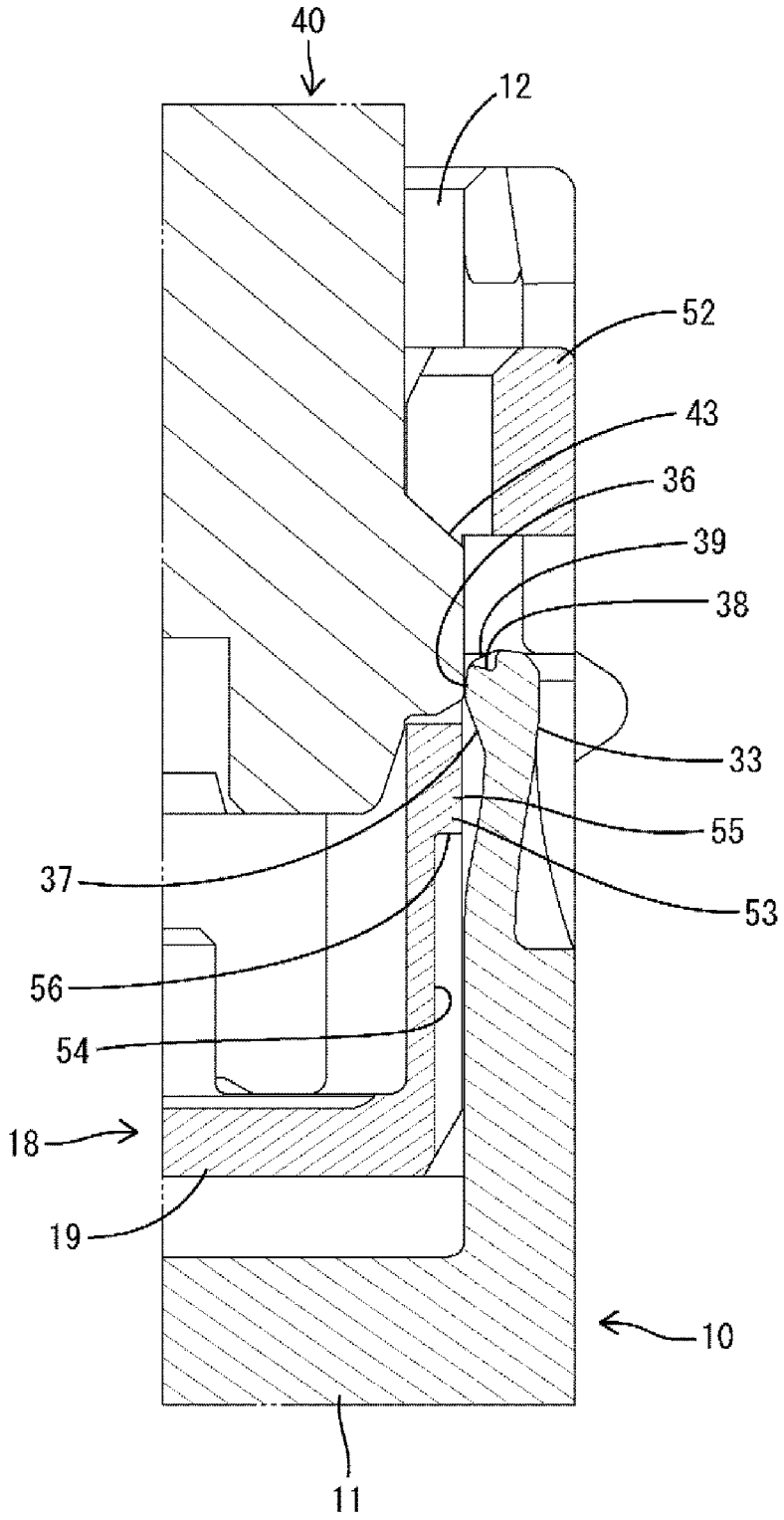
FIG. 17 is a plan view in section showing a state where the stopper is deflected and deformed by a releasing portion of the female housing and the locking of the stopper and the stopper receiving portion is released.
Figure 18:
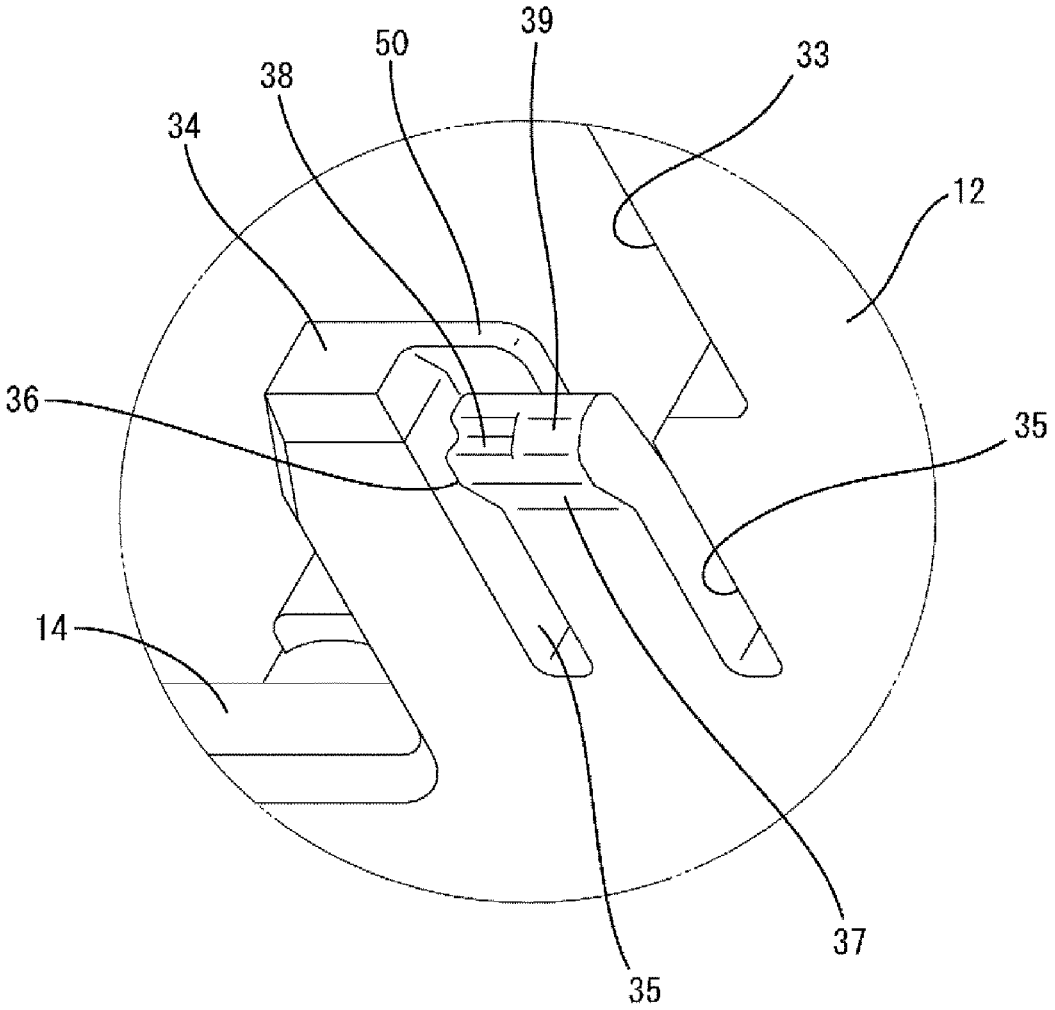
FIG. 18 is an enlarged perspective view of the stopper.
Figure 20:
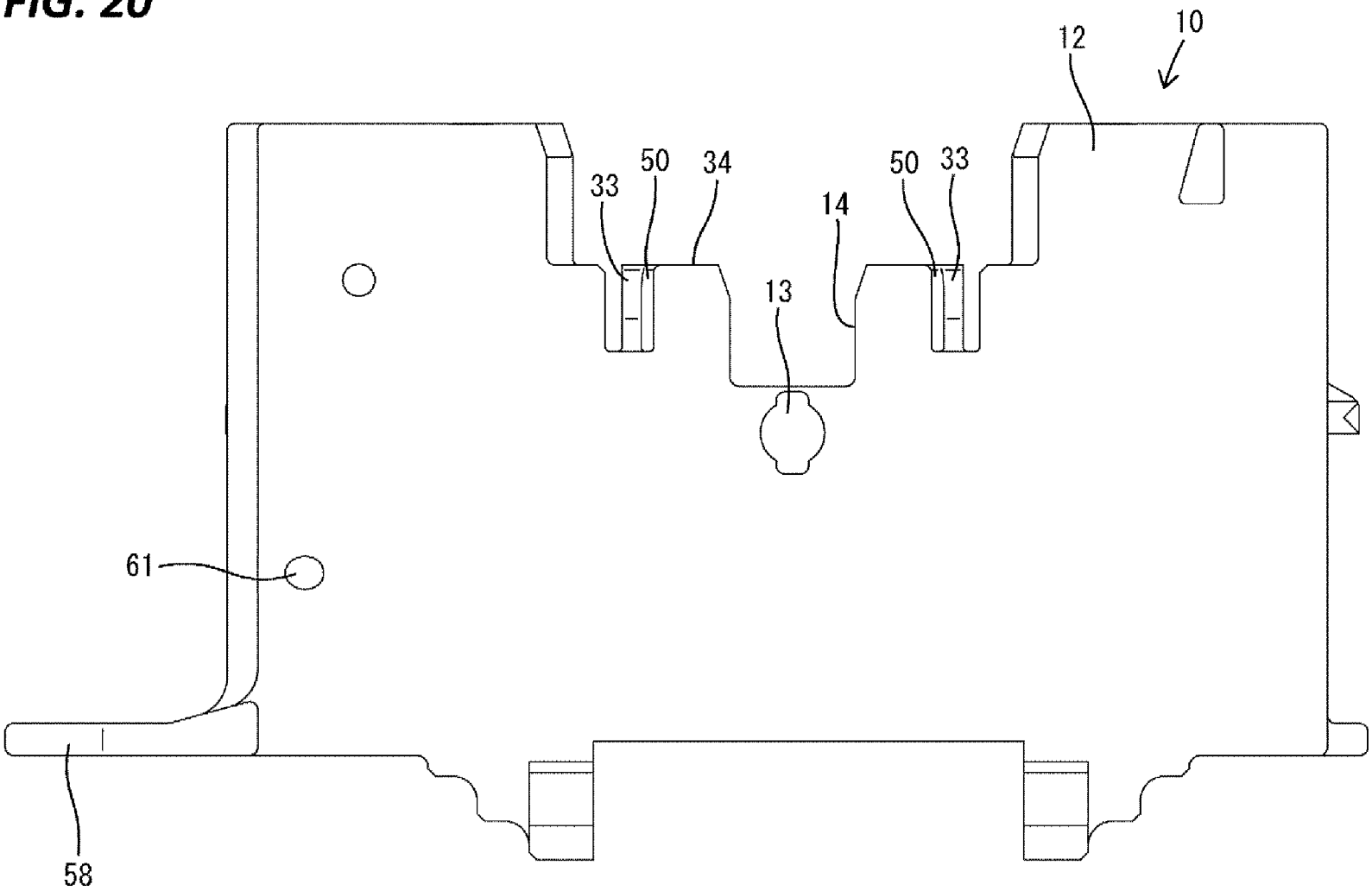
FIG. 20 is a side view of the male housing.

As shown in FIG. 20, end edge parts 34 are provided along the front-rear direction at positions slightly lower than the upper end edge of the receptacle 12 on both front and rear sides of an opening of the cutout portion 14 in each of the both left and right outer wall parts of the receptacle 12. As shown in FIG. 18, front and rear pairs of slits 35 extending in the vertical direction and open in the end edge part 34 are provided at positions corresponding to the respective end edge parts 34 in each of the left and right outer wall parts of the receptacle 12, and a pair of the stoppers 33 (only one is shown in FIG. 18) are provided to be deflectable and deformable between the pair of slits 35. The stopper 33 is cantilevered from a lower end part serving as a deflection fulcrum to an upper end part. As shown in FIG. 15, the stopper 33 is thinner than a surrounding part of the corresponding outer wall part of the receptacle 12, and disposed such that the outer surface thereof is retracted inwardly from the outer surface of the surrounding part of the outer wall part. A locking projection 36 is provided to project inward on an upper end part (tip part) of the stopper 33. The lower surface of the locking projection 36 is formed into an inclined surface 37 inclined gradually inwardly toward an upper side.

Figure 19:
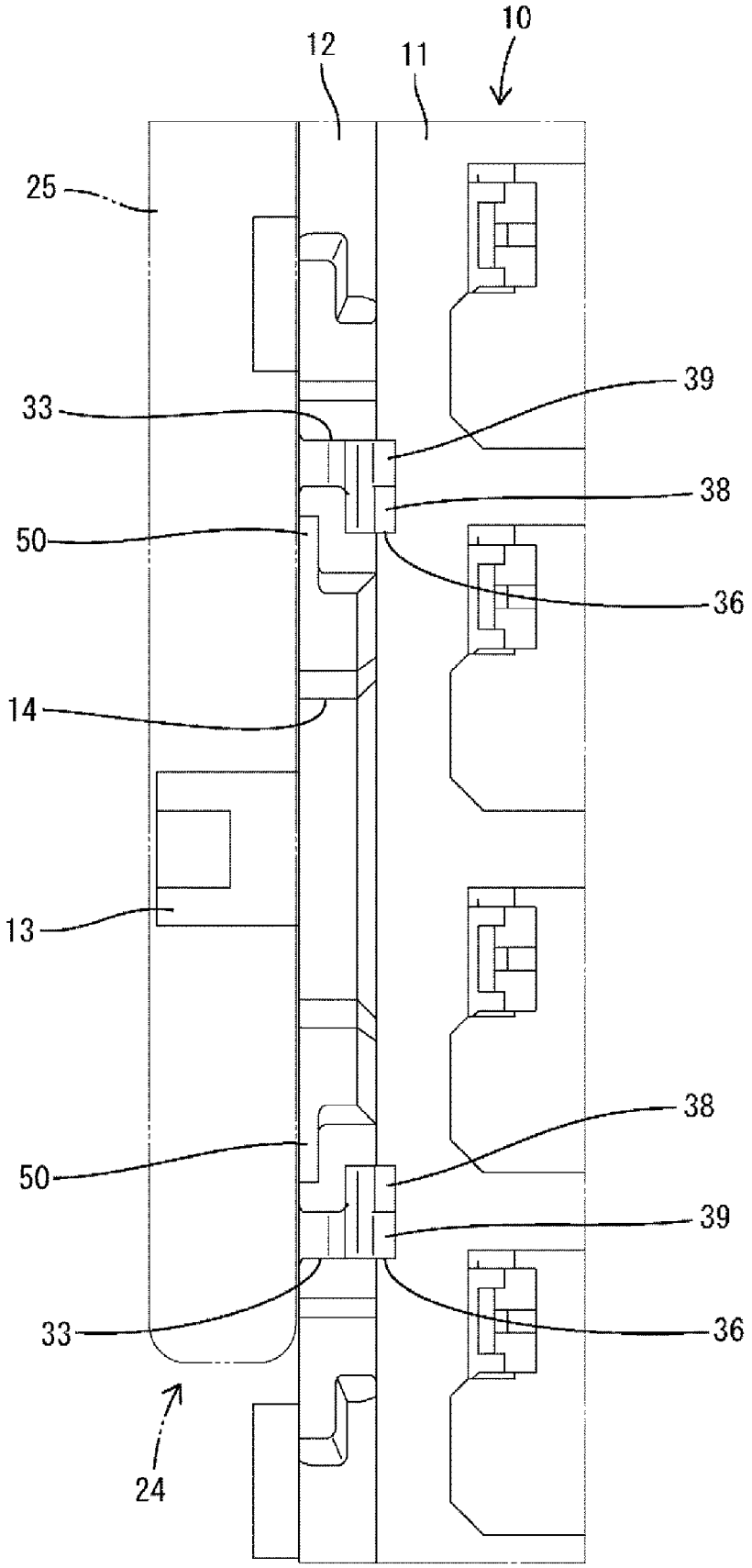
FIG. 19 is an enlarged front view showing a positional relationship of the stoppers, excessive deflection restricting portions and an arm portion.

As shown in FIGS. 18 and 19, the upper surface of the locking projection 36 is divided in the front-rear direction into a locking surface 38 and a releasing surface 39. The locking surface 38 is disposed along the front-rear direction at a back end of a recess formed by cutting a half (inner half) on a central side in the front-rear direction (side near the cutout portion 14) of the locking projection 36. The releasing surface 39 is disposed as a surface convex or tapered downward in a half (outer half) on a side distant from the center in the front-rear direction of the locking projection 36 (side distant from the cutout portion 14).

The left and right outer wall parts of the receptacle 12 are provided with excessive deflection restricting portions 50 for restricting excessive outward deflection and deformation of the stoppers 33. The excessive deflection restricting portions 50 are in the form of plate pieces thinner than the facing stoppers 33, cover the slits 35 on the central sides in the front-rear direction on the end edge parts 34, are disposed along edge parts on the central sides in the front-rear direction of the stoppers 33 and formed to protrude to cover these edge parts.

Figure 21:
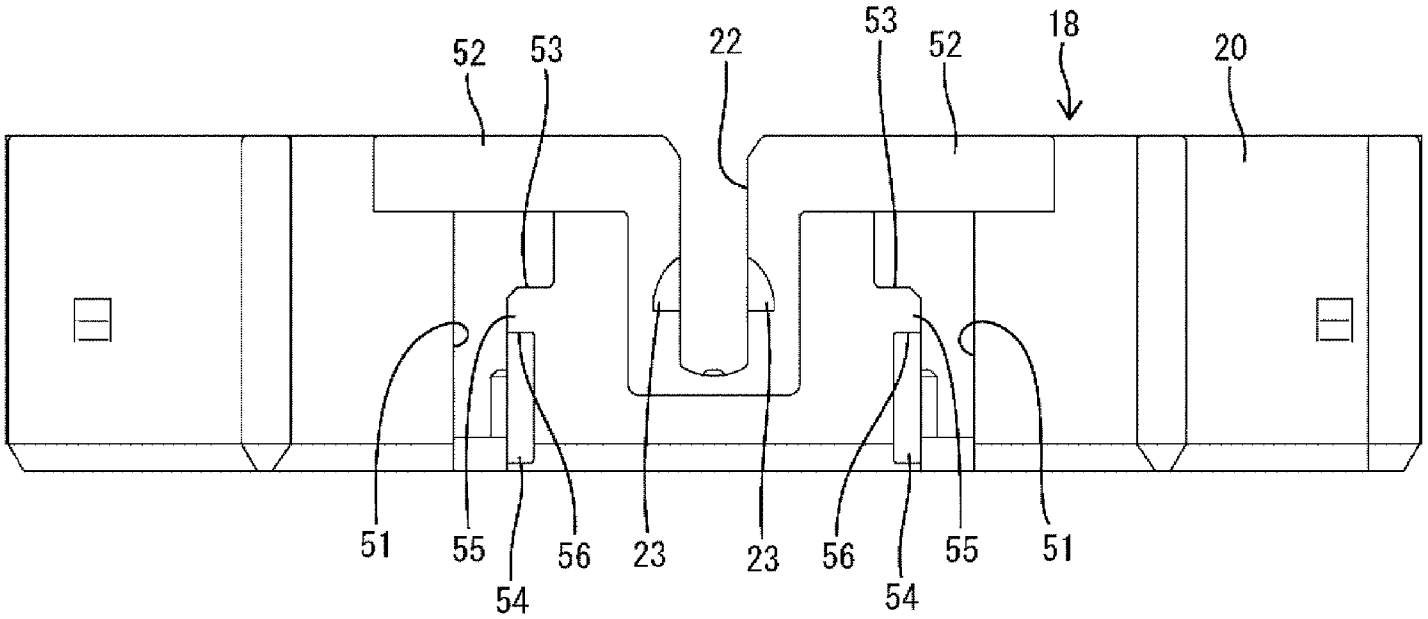
FIG. 21 is a side view of the moving plate.

As shown in FIG. 21, a pair of recessed grooves 51 are provided by being cut downward from the upper end edge of the peripheral wall portion 20 at spaced-apart positions on both front and rear sides across the guide groove 22 in each of both left and right outer side wall parts of the peripheral wall portion 20 of the moving plate 18, and bridge portions 52 are provided to straddle upper end openings of the recessed grooves 51. The stoppers 33 and the releasing portions 43 can enter the recessed grooves 51. The bridge portions 52 function to reinforce opening edge parts of the recessed grooves 51 and the guide grooves 22 in the upper end edge of the peripheral wall portion 20.

A pair of stopper receiving portions 53 are provided from the lower ends of edge parts on the central sides in the front-rear direction of the recessed grooves 51 to vertical intermediate parts on each of the both left and right side wall parts of the peripheral wall portion 20. Recesses 54 extending in the vertical direction and open in lower ends are provided in the outer surfaces of the stopper receiving portions 53. A stopper body receiving portion 55 in the form of a rectangular block is provided on an upper end part of the stopper receiving portion 53. The lower surface of the stopper body receiving portion 55 is formed into a lock receiving surface 56 along the front-rear direction for closing the upper end of the recess 54. The locking projection 36 of the stopper 33 can enter the recess 54 of the stopper receiving portion 53 (see FIG. 16).

When the moving plate 18 is at the protection position, the locking surface 38 of each stopper 33 is lockably disposed in contact with the lock receiving surface 56 of each stopper body receiving portion 55. In this way, a movement of the moving plate 18 toward the retracted position is restricted. At this time, the releasing surface 39 of each stopper 33 is shifted in position from each stopper body receiving portion 55 and disposed to face the recessed groove 51 of the moving plate 18.

Further, if the female housing 40 is lightly fit into the receptacle 12 with the moving plate 18 located at the protection position, the respective releasing portions 43 and the both cam pins 41 of the female housing 40 respectively enter the respective recessed grooves 51 and the both guide grooves 22 of the moving plate 18. As the female housing 40 is further fit, the respective releasing portions 43 come into contact with the releasing surfaces 39 of the respective stoppers 33 to press the releasing surfaces 39 and the respective stoppers 33 are deflected and deformed outwardly (see FIG. 17). In this way, the locking surfaces 38 of the respective stoppers 33 are separated from the lock receiving surfaces 56 of the respective stopper body receiving portion 55, the locking of the respective stoppers 33 and the respective stopper receiving portions 53 is released and the moving plate 18 becomes movable toward the retracted position. The respective stoppers 33 come into contact with the excessive deflection restricting portion 50 in deflecting directions thereof, whereby excessive outward deflection is restricted.

Here, the left and right outer wall parts of the receptacle 12 are respectively covered by the both arm portions 25 of the lever 24 and the both arm portions 25 are disposed in proximity to the outer surfaces of these outer wall parts (see FIG. 19). Thus, the interference of the stoppers 33 and the arm portions 25 can be avoided by the contact of the stoppers 33 with the excessive deflection restricting portion 50.

In the initial stage of the rotation of the lever 24 to the connection position, the respective stopper body receiving portion 55 and the respective releasing portions 43 pass through the respective locking projections 36, the respective locking projections 36 enter spaces on back sides of the respective releasing portions 43 and the respective stoppers 33 resiliently return to an initial state (natural state).

On the other hand, in separating the both housings 10, 40, the respective stopper body receiving portion 55 slide in contact with the inclined surfaces 37 of the respective locking projections 36 to deflect and deform the respective stoppers 33 outwardly in the process of moving the moving plate 18 from the retracted position to the protection position. When the moving plate 18 reaches the protection position, the respective stopper body receiving portion 55 pass through the respective locking projections 36, the respective stoppers 33 resiliently return to the initial state, the lock receiving surfaces 56 of the respective stopper body receiving portion 55 face and come into contact with the locking surfaces 38 of the respective stoppers 33 and the moving plate 18 is held at the protection position again.

In the above case, a structure for preventing the moving plate 18 from dropping to the retracted position cannot be formed in the lever 24 since the cam projections 23 of the moving plate 18 are not structured to lock the connecting cam surfaces 29 of the cam grooves 28 when the both housings 10, 40 are separated. In view of this, the stoppers 33 of the male housing 10 are structured to lock the stopper receiving portions 53 of the moving plate 18 in the above configuration, whereby the moving plate 18 does not inadvertently drop to the retracted position and the tabs 17 are reliably protected by the moving plate 18 at the protection position.

Further, since the stopper receiving portions 53 are provided on the peripheral wall portion 20 of the moving plate 18, the plate body portion 19 is not structurally restricted by the stopper receiving portions 53 and a degree of freedom in the arrangement of the tabs 17 can be enhanced.

Further, since the excessive deflection restricting portions 50 for covering the stoppers 33 are provided between the stoppers 33 and the arm portions 25, the interference of the stoppers 33 with the arm portions 25 can be avoided by the contact of the stoppers 33 with the excessive deflection restricting portions 50 and the lever 24 can be rotated without any trouble.

Further, since the locking projections 36 capable of locking the stopper receiving portions 53 are provided on the upper end parts of the stoppers 33 and the locking projections 36 are provided with the inclined surfaces 37 with which the stopper receiving portions 53 slide in contact in the process of moving the moving plate 18 to the protection position, the stoppers 33 can be smoothly deflected and deformed in the process of moving the moving plate 18 to the protection position.

Furthermore, since the locking surface 38 and the releasing surface 39 are provided in a divided manner on the locking projection 36, a locking structure (locking surface 38) for the stop receiving portion 53 and a releasing structure (releasing surface 39) for the releasing portion 43 can be respectively suitably formed. Further, the progress of abrasion of the both surfaces 38, 39 can be suppressed as compared to the case where the locking surface 38 and the releasing surface 39 are formed by the same surface.

(Detailed Mode 2)

Next, the shape of grooves (standby grooves 57) communicating with the cam grooves 28 of the lever 24 and detailed structures and functions of parts relating to these grooves are described mainly with reference to FIGS. 22 to 25B.

Figure 23:
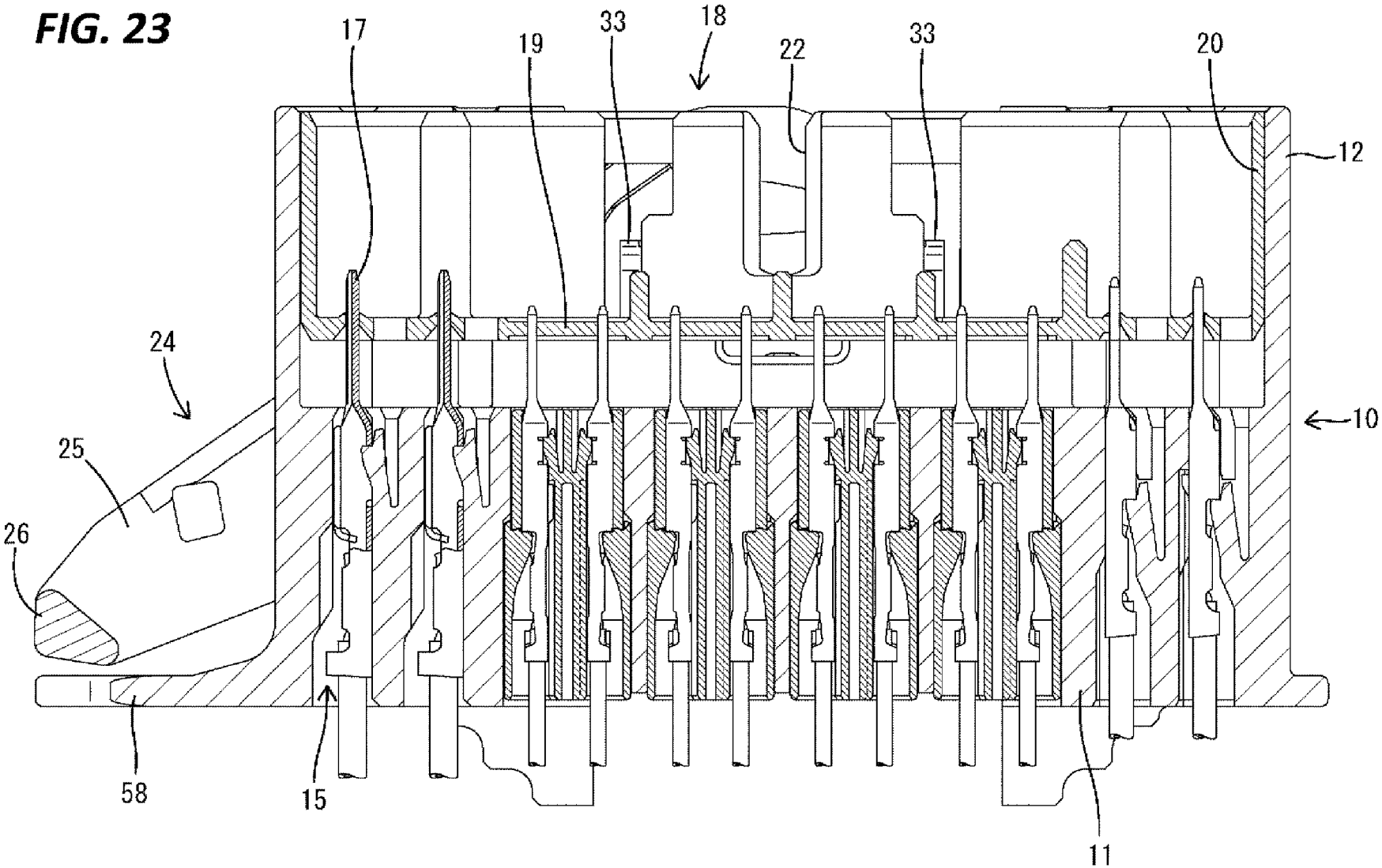
FIG. 23 is a side view in section showing the state where the lever is at the standby position.

As shown in FIG. 23, the male housing 10 includes a protruding piece 58 projecting forward on a lower end part of the terminal holding portion 11. The male housing 10 is fit into an unillustrated bracket. The fitting of the male housing 10 more than necessary can be restricted by the contact of the protruding piece 58 with the bracket.

Figure 24:
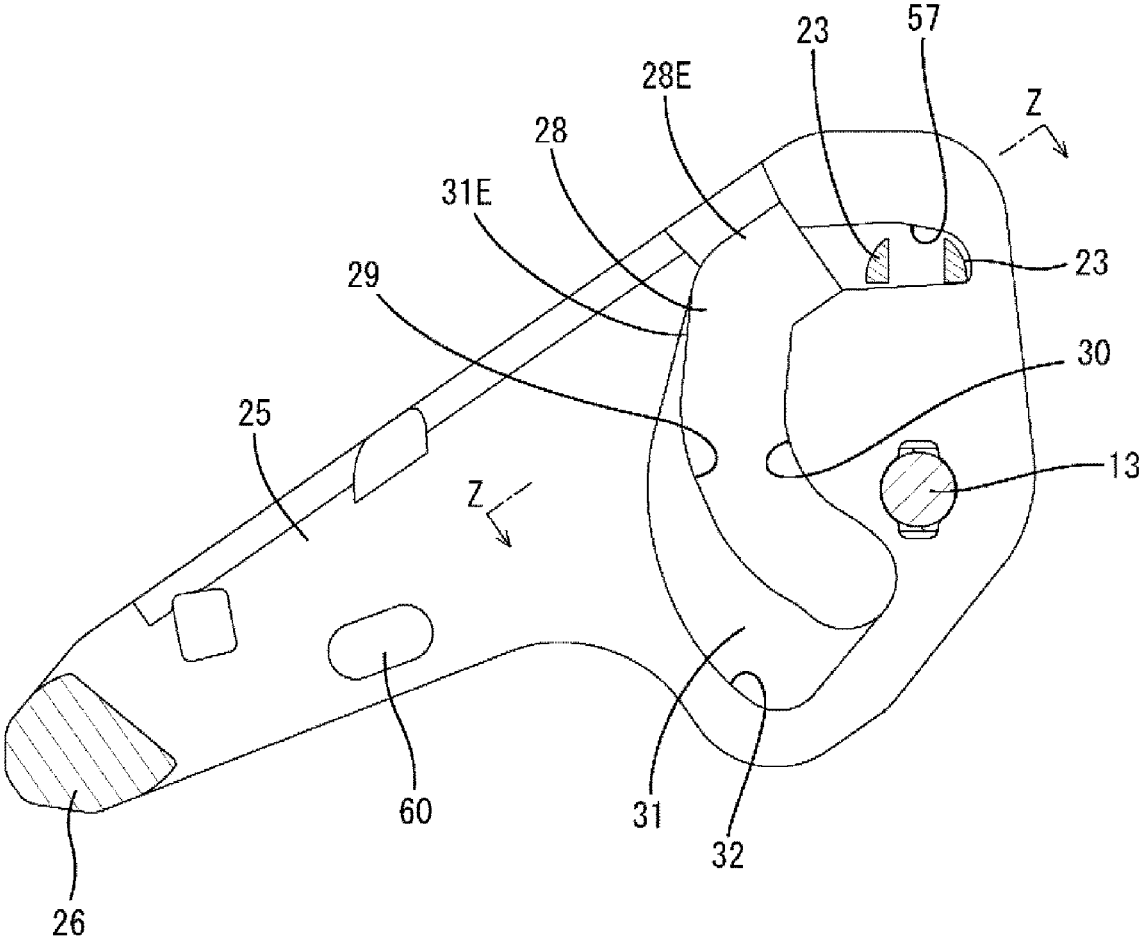
FIG. 24 is a side view in section showing a positional relationship of the cam projections, the cam groove and a standby groove with the lever located at the standby position.

A pair of the standby grooves 57 adjacent to and communicating with the entrances 28E of the cam grooves 28 on a side opposite to the entrances 31E of the escaping spaces 31 and extending in a direction to increase lengths of the cam grooves 28 are provided in the inner side surfaces of the both arm portions 25 of the lever 24 (see FIG. 24). Each of the both standby grooves 57 is formed to have a groove width smaller than that of the cam groove 28 (separation distance between the connecting cam surface 29 and the separating cam surface 30). Out of both groove surfaces (surfaces facing in a groove width direction) of the standby groove 57, the groove surface closer to the bearing hole 27 is continuous with the separating cam surface 30 substantially without any step. The both groove surfaces of the standby groove 57 do not exhibit a cam action and are engaged (cam engagement) with neither the cam projections 23 nor the cam pin 41.

Figure 25B:
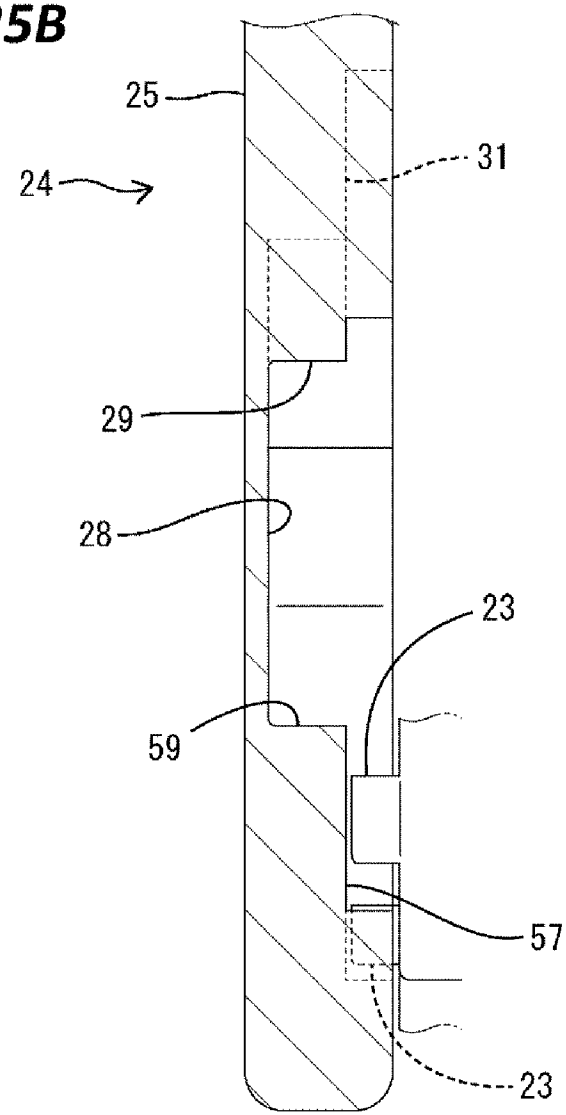
FIG. 25B is a section along Z-Z of FIG. 24 corresponding to FIG. 25A.
Figure 25A:
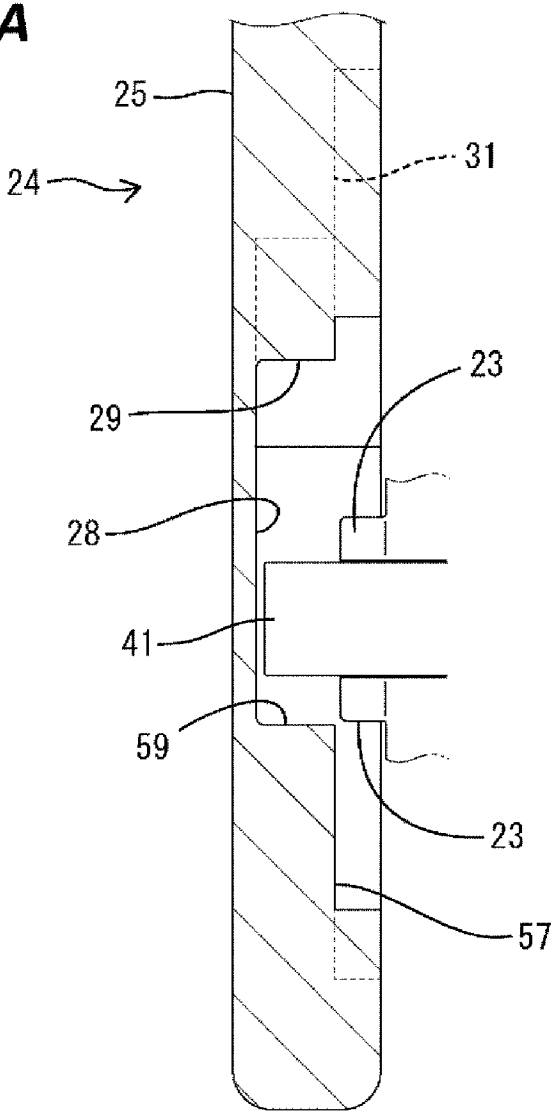
FIG. 25A is a side view in section showing a positional relationship of the cam projections, the cam pin, the cam groove and the standby groove with the lever located at the initial position

As shown in FIGS. 25(A) and 25(B), a depth of the standby groove 57 (distance from the inner side surface of the arm portion 25 in a plate thickness direction of the arm portion 25) is set smaller than that of the cam groove 28. A step 59 in a depth direction (plate thickness direction of the arm portion 25) is provided between the standby groove 57 and the cam groove 28, and the bottom surface of the cam groove 28 is at a position deeper than the bottom surface of the standby groove 57. The step 59 is disposed to extend in the depth direction and is configured as a wall surface partially defining a communicating part with the entrance 28E along the groove width direction of the cam groove 28.

The depth of the cam groove 28 is larger than the projecting dimensions of the cam projections 23 and the cam pin 41, and the cam projections 23 and the cam pin 41 can enter the cam groove 28. On the other hand, the depth of the standby groove 57 is larger than the projecting dimension of the cam projections 23 and smaller than that of the cam pins 41. Thus, the entrance of the cam projections 23 into the standby groove 57 is allowed, but the entrance of the cam pin 41 into the standby groove 57 is restricted. The entrance of the cam pin 41 toward the side of the standby groove 57 is obstructed by the interference of the tip part of the cam pin 41 in the projecting direction with the step 59 on the side of the entrance 28E of the cam groove 28.

The both arm portions 25 are provided with the cam grooves 28, the standby grooves 57 and the escaping spaces 31 in wide parts distant from the operating portion 26, and a pair of holding portions 60 in the form of bottomed recesses are provided in the inner side surfaces of narrow parts on the side of the operating portion 26 (see FIG. 24).

The lever 24 is assembled to straddle the male housing 10 and rotatable between the initial position and the connection position and between the initial position and a standby position about the rotary shafts 13. At the initial position, the operating portion 26 is disposed to project forward from the upper end part of the male housing 10 (see FIGS. 1 and 2). At the connection position, the operating portion 26 is disposed to project upward from the upper end part of the male housing 10 (see FIG. 3).

Figure 22:
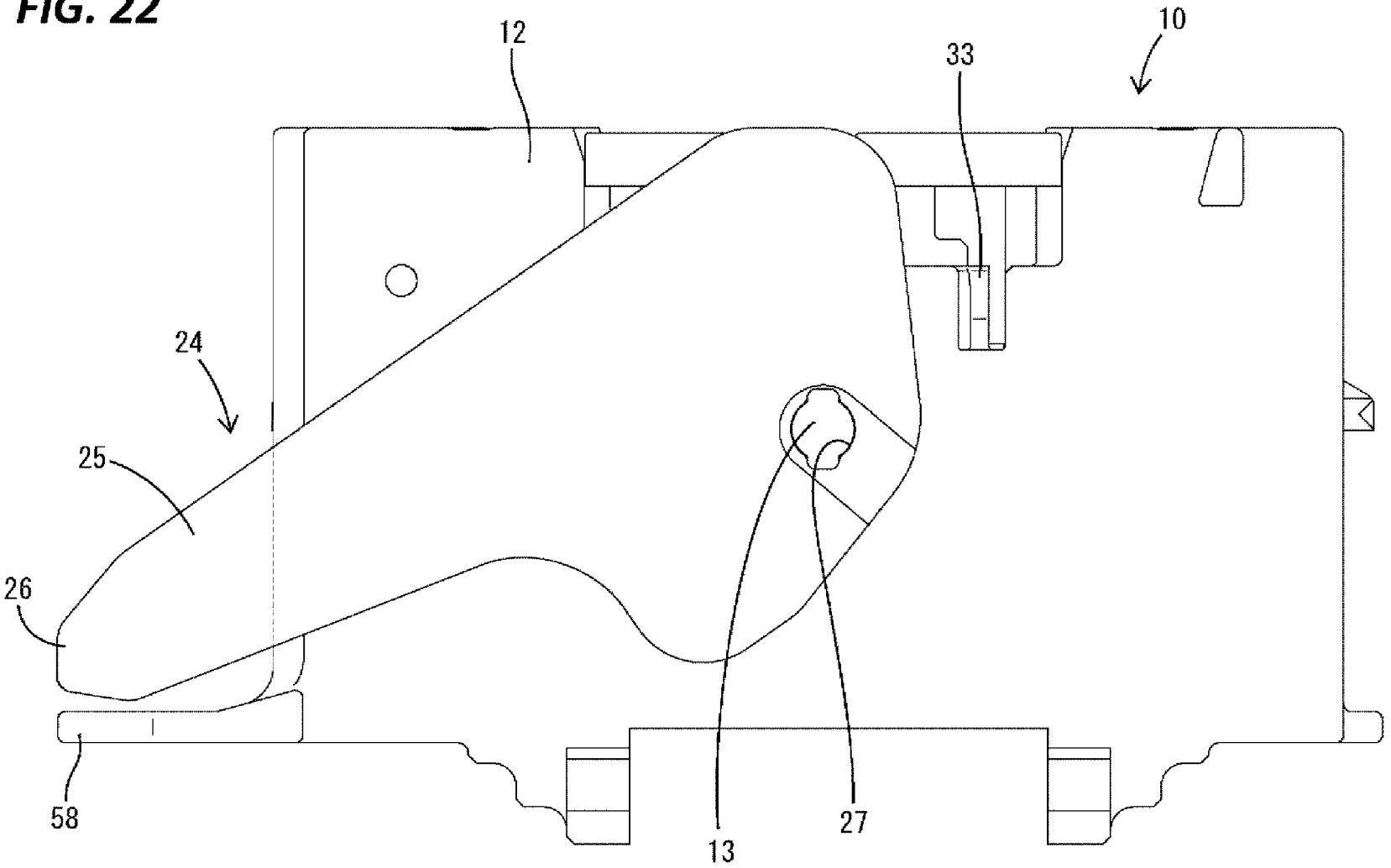
FIG. 22 is a side view showing a state where the lever is at a standby position.

At the standby position, the operating portion 26 projects forward from a lower end part of the male housing 10 and is disposed in proximity to the protruding piece 58 (see FIGS. 22 and 23). Thus, even if an unillustrated other member is pressed against the operating portion 26 from above, that pressing force can be received by the protruding piece 58 and an excessive stress is not generated in the lever 24. Further, the other member moving upward from a lower position does not interfere with the lever 24 by contacting the protruding piece 58. Thus, the lever 24 is protected at the standby position and the application of an inadvertent operation force to the operating portion 26 is obstructed.

If a worker is going to erroneously rotate the lever 24 toward the standby position on a side opposite to the connection position when the both housings 10, 40 are connected, the cam pins 41 having entered the entrances 28E of the cam grooves 28 come into contact with the steps 59 to obstruct movements of the cam pins 41 toward the standby grooves 57. Therefore, an erroneous operation of the lever 24 from the initial position to the standby position is avoided when the both housings 10, 40 are connected.

If a pressing force acting toward the standby position is applied to the operating portion 26 with the both housings 10, 40 separated, the cam projections 23 move toward the standby grooves 57 and the lever 24 can reach the standby position with the moving plate 18 held at the protection position. At the standby position, the holding portions 60 of the both arm portions 25 are locked to holding receiving portions 61 (see FIG. 20) provided on front end sides of the outer side surfaces of the receptacle 12, whereby the lever 24 is held in a rotation restricted state with respect to the male housing 10.

The cam projections 23 are not engaged with the groove surfaces of the standby grooves 57 in the standby grooves 57 and the moving plate 18 is kept at the protection position while the lever 24 is rotated between the initial position and the standby position. Note that, when the moving plate 18 is at the protection position, an unillustrated probe pin can be brought into contact with a most tip part of each tab 17 projecting upward from the plate body portion 19, whereby a conduction test can be performed for each male terminal fitting 15.

As just described, with the lever 24 held at the initial position and the female housing 40 lightly fit in the receptacle 12, the cam pins 41 enter the entrances 28E of the cam grooves 28, but the entrance thereof into the standby grooves 57 is restricted by the steps 59. Thus, when the both housings 10, 40 are connected, erroneous rotation of the lever 24 from the initial position to the standby position is obstructed. Therefore, the both housings 10, 40 can be smoothly and quickly connected.

Other Embodiments

The present invention is not limited to the above described and illustrated embodiment. For example, the following embodiments are also included in the technical scope of the present invention.

(1) Although the moving plate is held at the protection position in the process of rotating the lever from the initial position to the connection position with the both housings separated in the above embodiment, the moving plate may be slightly moved toward the retracted position in the rotation process of the lever.

(2) Although the cam groove is disposed on the inner peripheral side closer to the rotary shaft than the escaping space in the above embodiment, the escaping space may be conversely disposed on the inner peripheral side closer to the rotary shaft than the cam groove. In this case, the separating cam surface may be formed in a groove portion (space) different from the cam groove.

(3) Although the restricting surface along the outer peripheral edge of the escaping space is formed in the above embodiment, the escaping space may be formed with no restricting surface and open in the outer peripheral edge of the lever.

(4) Although the entrance of the cam groove and that of the escaping space are adjacent to and communicate with each other in the above embodiment, the entrance of the cam groove and that of the escaping space may be separate spaces.

(5) Although the cam projections of the moving plate are not engaged with the groove surfaces of the standby grooves in the standby grooves in the above embodiment, the cam projections may enter the standby grooves, be engaged with the groove surfaces of the standby grooves and exhibit a cam action by the rotation of the lever. For example, the moving plate may be structured not to cause the tip parts of the tabs to project from the plate body portion at the protection position, and the cam projections may be pressed against the groove surfaces of the standby grooves, the moving plate may move toward the retracted position and the most tip parts of the tabs may project from the plate body portion to enable a conduction test in the process of rotating the lever from the initial position to the connection position.

(6) Although the cam groove is formed as a bottomed groove in the arm portion of the lever in the above embodiment, the cam groove may be formed as a bottomless groove penetrating in the plate thickness direction in the arm portion. In this case, the plate thickness of the arm portion is equivalent to the depth of the cam groove.

(7) In the above embodiment, the stoppers are provided to be deflectable and deformable on the male housing and the stopper receiving portions are provided not to be substantially deflectable and deformable on the moving plate. Conversely, the stopper receiving portions may be provided to be deflectable and deformable on the moving plate and the stoppers may be provided not to be substantially deflectable and deformable on the male housing.

(8) Although the pair of cam projections are provided across the guide groove in the above embodiment, only one cam projection may be provided at a position engageable with the separating cam surface of the cam groove.

LIST OF REFERENCE NUMERALS

10 . . . male housing
12 . . . receptacle
13 . . . rotary shaft (center of rotation of lever)
15 . . . male terminal fitting
17 . . . tab
18 . . . moving plate
23 . . . cam projection
24 . . . lever
28 . . . cam groove
28E . . . entrance of cam groove
29 . . . connecting cam surface
30 . . . separating cam surface
31 . . . escaping space
31E . . . entrance of escaping space
32 . . . restricting surface
33 . . . stopper
40 . . . female housing
41 . . . cam pin
50 . . . excessive deflection restricting portion
53 . . . stopper receiving portion
57 . . . standby groove
59 . . . step

What is claimed is:

1. A lever-type connector, comprising:

a male housing including a tubular receptacle projecting toward a front surface side;

a plurality of male terminal fittings mounted in the male housing, the male terminal fittings including tabs surrounded by the receptacle;

a moving plate accommodated in the receptacle, the moving plate being movable between a protection position where tip parts of the plurality of tabs are positioned by being passed through the moving plate and a retracted position more toward a back surface side than the protection position;

a cam projection formed on the moving plate;

a lever mounted on the male housing, the lever being rotatable between an initial position and a connection position; and a female housing fittable into the receptacle, wherein:

the lever is formed with a separating cam surface and an escaping space disposed in a region more distant from a center of rotation of the lever than the separating cam surface, the separating cam surface presses the cam projection in a direction away from the center of rotation of the lever to move the moving plate from the retracted position to the protection position in the process of rotating the lever at the connection position to the initial position when the male housing and the female housing are connected, and the cam projection is accommodated into the escaping space while being separated from the separating cam surface in the process of rotating the lever from the initial position to the connection position when the male housing and the female housing are separated and when the moving plate is located at the protection position.

2. The lever-type connector of claim 1, wherein the lever is formed with a restricting surface disposed to face the center of rotation of the lever and extend along an outer peripheral edge of the escaping space.

3. The lever-type connector of claim 1, comprising:

a cam groove formed in the lever;

a standby groove formed in the lever, the standby groove communicating with the cam groove; and a cam pin formed on the female housing, the cam pin being displaced to a back side of the cam groove and pressed in a connecting direction by the cam groove as the lever is rotated from the initial position to the connection position in a connection process of the male housing and the female housing, wherein:

the standby groove is formed to be shallower than the cam groove, the lever is rotated from the initial position toward a side opposite to the connection position to reach a standby position, and the lever is formed with a step between the cam groove and the standby groove for allowing the entrance of the cam projection into the standby groove and restricting the entrance of the cam pin into the standby groove at the standby position.

4. The lever-type connector of claim 1, wherein:

the male housing includes a stopper, and the moving plate includes a stopper receiving portion configured to be locked by the stopper at the protection position and to release a locked state with the stopper when the female housing is lightly fit into the receptacle.

5. The lever-type connector of claim 4, wherein the moving plate includes a peripheral wall portion on an outer periphery of a plate body portion through which the tip parts of the tabs pass, the stopper receiving portion is provided on the peripheral wall portion and the stopper is provided on the receptacle.

6. The lever-type connector of claim 5, wherein the stopper is deflectable and deformable in a direction toward a plate-like arm portion provided in the lever, and the receptacle includes an excessive deflection restricting portion covering the stopper between the stopper and the arm portion.

7. The lever-type connector of claim 1, comprising:

a cam groove formed in the lever; and a cam pin formed on the female housing, the cam pin being pressed in a connecting direction by the cam groove as the lever is rotated from the initial position to the connection position in a connection process of the male housing and the female housing, wherein:

the escaping space communicates with the cam groove, and the separating cam surface is formed in the cam groove.

8. The lever-type connector of claim 7, wherein:

the escaping space is less recessed than the cam groove, and a projecting dimension of the cam pin is set larger than a projecting dimension of the cam projection.

9. The lever-type connector of claim 7, wherein the cam groove is formed with a connecting cam surface not in contact with the cam projection and configured to give a pressing force to the cam pin in the process of connecting the male housing and the female housing.

10. The lever-type connector of claim 7, wherein an entrance of the escaping space is adjacent to and communicates with an entrance of the cam groove.

* * * * *